US011351084B1

(12) United States Patent
Gifford

(10) Patent No.: US 11,351,084 B1
(45) Date of Patent: Jun. 7, 2022

(54) MUSCLE THERAPY DEVICE

(71) Applicant: MOTIONWISE, LLC, Berkley, MI (US)

(72) Inventor: John Gifford, Berkley, MI (US)

(73) Assignee: MOTIONWISE, LLC, Berkley, MI (US)

( * ) Notice: Subject to any disclaimer, the term of this patent is extended or adjusted under 35 U.S.C. 154(b) by 115 days.

(21) Appl. No.: 16/600,205

(22) Filed: Oct. 11, 2019

Related U.S. Application Data

(63) Continuation-in-part of application No. 15/014,512, filed on Feb. 3, 2016, now abandoned.

(51) Int. Cl.
*A61H 7/00* (2006.01)

(52) U.S. Cl.
CPC ..... *A61H 7/003* (2013.01); *A61H 2201/0153* (2013.01); *A61H 2201/1253* (2013.01); *A61H 2201/1692* (2013.01)

(58) Field of Classification Search
CPC ..... A61H 7/003; A61H 2201/0107; A61H 2201/1685; A61H 23/00; A61H 2015/0014; A63B 19/00; A63B 19/02; A63B 19/04
See application file for complete search history.

(56) References Cited

U.S. PATENT DOCUMENTS 4,052,982 A 10/1977 Ozeryansky
5,848,980 A 12/1998 Demerais
6,217,482 B1 * 4/2001 Yoo ..... A63B 19/00 482/10
6,241,693 B1 6/2001 Lambden
6,309,273 B1 * 10/2001 Kim ..... A63B 19/00 446/236
9,468,790 B1 10/2016 Snead
2012/0157272 A1 * 6/2012 Kessler ..... A63B 21/0608 482/110
2013/0023807 A1 1/2013 Hennessey
2014/0088469 A1 3/2014 Wise
2014/0155794 A1 6/2014 Tambakis
2014/0350445 A1 11/2014 Lok et al.
(Continued)

FOREIGN PATENT DOCUMENTS

WO 0021481 A2 4/2000
WO WO-2015030487 A1 * 3/2015 ..... A63B 19/00

OTHER PUBLICATIONS

Machine Translation of WO 2015030487A1 Description Only, printed on Sep. 30, 2021 (Year: 2021).*
(Continued)

*Primary Examiner* — Samchuan C Yao
*Assistant Examiner* — Cana A Gallegos
(74) *Attorney, Agent, or Firm* — Jacob M. Ward; Ward Law Office LLC

(57) ABSTRACT

A muscle therapy device is provided. The muscle therapy device includes a substantially ring-shaped member. The muscle therapy device further includes first and second protrusion members that are coupled to the substantially ring-shaped member and extend radially inwardly from the substantially ring-shaped member. The first protrusion member has a first length, and the second protrusion member has a second length greater than the first length. The muscle therapy device further includes first and second tip members being coupled to the first and second protrusion members, respectively.

20 Claims, 24 Drawing Sheets

(56) References Cited

U.S. PATENT DOCUMENTS

| | | | | |
|---|---|---|---|---|
| 2015/0011921 | A1 | 1/2015 | Sidhu | |
| 2015/0273260 | A1* | 10/2015 | Hotchkis ..... | A63B 19/00 482/23 |
| 2016/0136032 | A1 | 5/2016 | Dakides | |

OTHER PUBLICATIONS

"Pro Massaging Hoop Exerciser with Magnet" at http://www.amazon.com/Pro-Massaging-Hoop-Exerciser-Magnet/dp/B002OQDAL4/ref=sr_1_1?ie=UTF8&qid=1454436507&sr=8-1&keywords=pro+massaging+hoop+exerciser+with+magnet, p. 1, date of retrieval Feb. 26, 2015.

* cited by examiner

MUSCLE THERAPY DEVICE

CROSS-REFERENCE TO RELATED APPLICATIONS

This application is a continuation-in-part of U.S. patent application Ser. No. 15/014,512, filed on Feb. 3, 2016. The entire disclosure of the above application is hereby incorporated herein by reference.

BACKGROUND

The inventor herein have recognized a need for a muscle therapy device that utilizes a substantially ring-shaped member having protrusion members of varying lengths extending therefrom, that could be utilized for muscle therapy treatments.

SUMMARY

A muscle therapy device in accordance with an exemplary embodiment is provided. The muscle therapy device includes a substantially ring-shaped member. The muscle therapy device further includes first and second protrusion members that are coupled to the substantially ring-shaped member and extend radially inwardly from the substantially ring-shaped member. The first protrusion member has a first length, and the second protrusion member has a second length greater than the first length. The muscle therapy device further includes first and second tip members being coupled to the first and second protrusion members, respectively.

In one embodiment, a muscle therapy device has a ring shaped member. At least a portion of the ring shaped member has an H-shaped cross section, which is adapted to stiffen the ring shaped member. At least one protrusion member is coupled to the ring shaped member. The at least one protrusion extends radially inwardly from the ring shaped member. At least one tip member is disposed on the at least on protrusion member.

In another embodiment, a muscle therapy device, has a ring shaped member. At least a portion of the ring shaped member has an H-shaped cross section, which is adapted to stiffen the ring shaped member. The ring shaped member has a plurality of arcuate portions including a first arcuate portion and a second arcuate portion. Each of the plurality of arcuate portions has a main body. The main body has at least a portion with the H-shaped cross section disposed between a male end and a female end. The male end of the first arcuate portion is selectively, removably coupled to the female end of the second arcuate portion. The female end has a hollow portion defined by at least one side wall with at least one aperture formed in the at least one side wall. The male end has at least one button connector disposed on at least one side wall. The button connector of the male end of the first arcuate portion is disposed in the aperture of the female end of the second arcuate portion. At least two protrusion members are coupled to the ring shaped member. The at least two protrusion members extending radially inwardly from the ring shaped member. Each of the protrusion members have a semi-circular shape. The first protrusion member is disposed on the ring shaped member opposite to where the second protrusion member is disposed on the ring shaped member. At least one tip member is disposed on the at least two protrusion members. Each of the arcuate portions has a pair of hooks, with one of the pair of hooks disposed adjacent to the male end and an other of the pair of hooks disposed adjacent to the female end. Each of the female end and the male end have at least one lock hole formed therethrough. The at least one lock hole of the female end is disposed above the at least one lock hole of the male end. The lock holes are configured to receive a fastener.

In a further embodiment, a method of using a muscle therapy device, the method comprising the steps of: providing the muscle therapy device; positioning the muscle therapy device at a predetermined location on a body of a user; applying pressure to the muscle therapy device; and contacting the predetermined location with the at least one tip member of the muscle therapy device.

DETAILED DESCRIPTION

Figure 1:
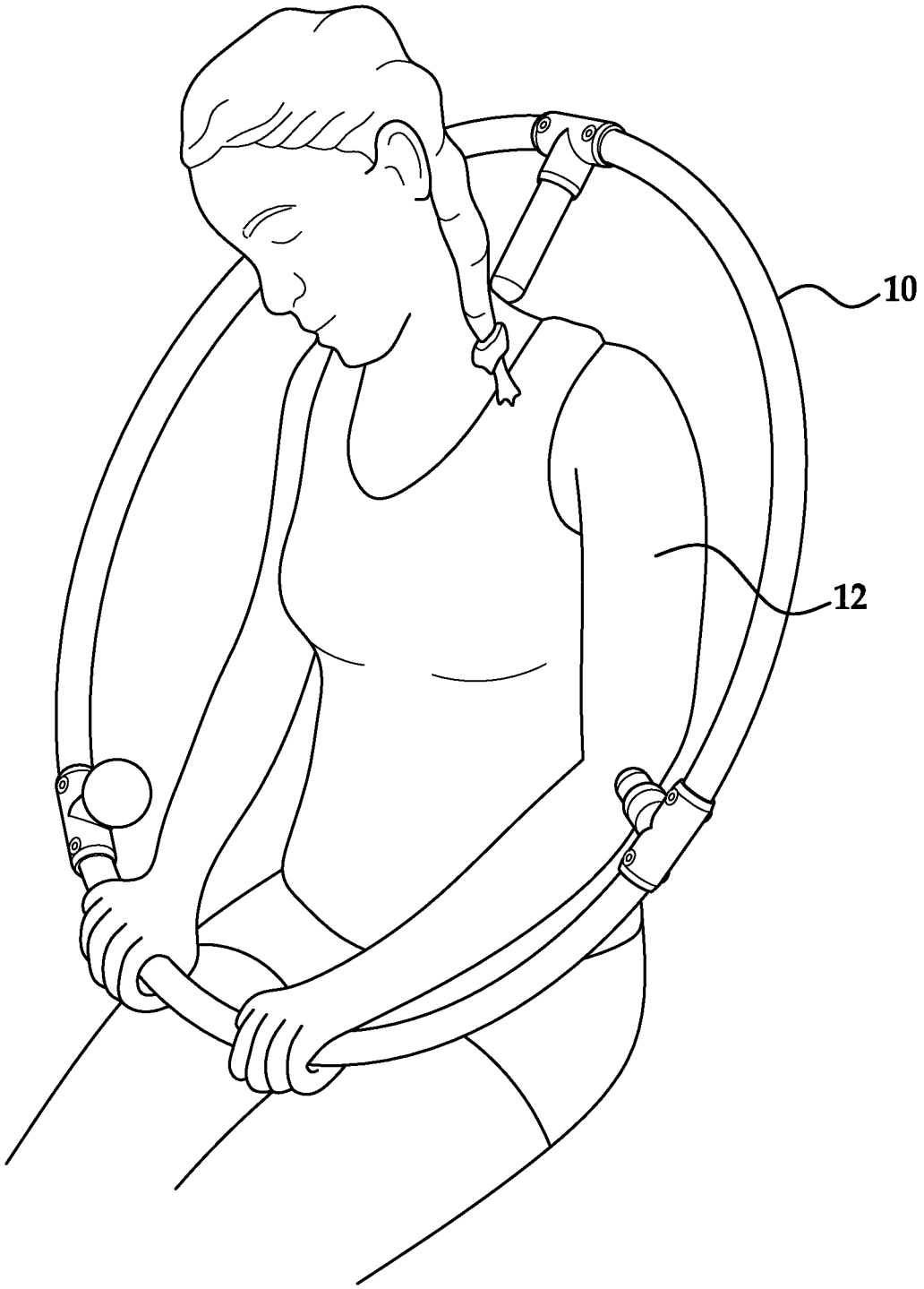
FIG. 1 is a schematic of a muscle therapy device in accordance with a first exemplary embodiment being utilized by a user.
Figure 2:
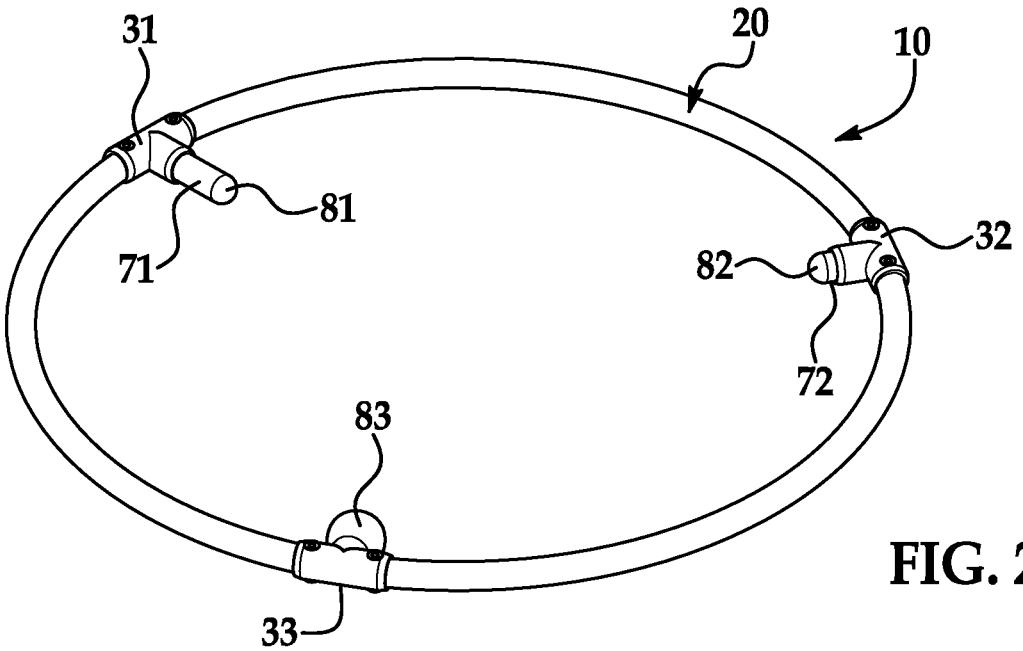
FIG. 2 is a schematic of the muscle therapy device of FIG. 1.

The following description is merely exemplary in nature and is not intended to limit the present disclosure, application, or uses. In respect of the methods disclosed, the order of the steps presented is exemplary in nature, and thus, is not necessary or critical unless otherwise disclosed.

Referring to FIGS. 1-5, a muscle therapy device 10 that could be utilized by a user 12 for muscle therapy treatments, in accordance with an exemplary embodiment is provided. The muscle therapy device 10 includes a substantially ring-shaped member 20, attachment members 31, 32, 33, rivets, 40, 42, 44, 46, 50, 52, 54, 56, 60, 62, 64, 66, protrusion members 71, 72, and tip members 81, 82, 83.

Figure 6:
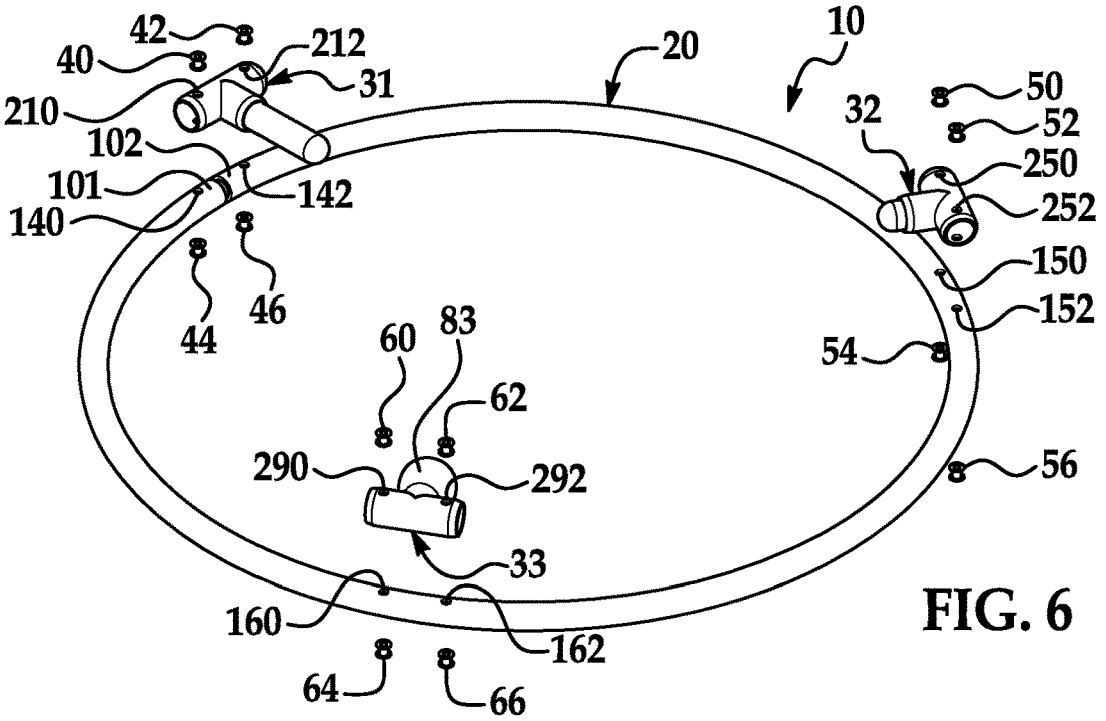
FIG. 6 is an exploded view of the muscle therapy device of FIG. 1.
Figure 7:
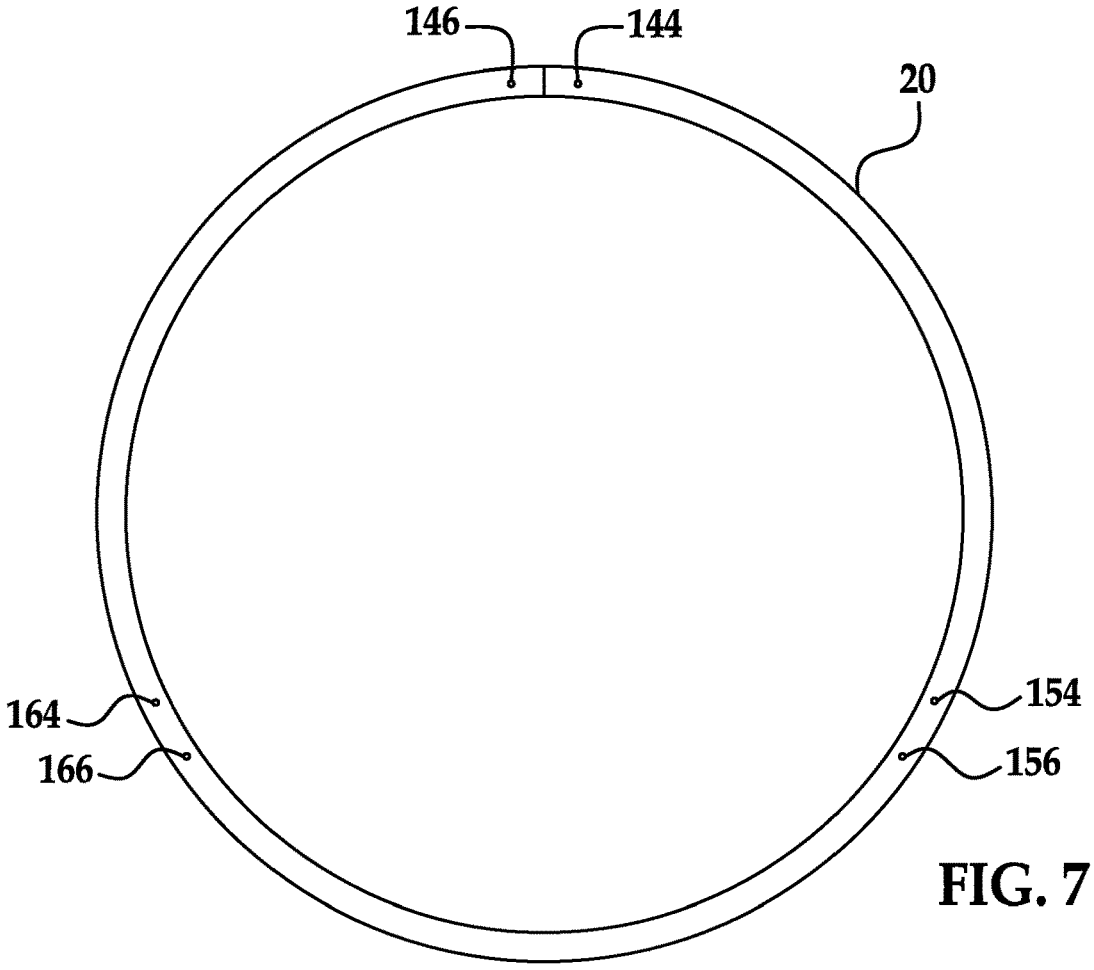
FIG. 7 is a schematic of a substantially ring-shaped member utilized in the muscle therapy device of FIG. 1.

Referring to FIGS. 6 and 7, the substantially ring-shaped member 20 is a tubular member constructed of plastic and extends in a range of 290°-360° in circumference. For example, in an exemplary embodiment, the substantially ring-shaped member 20 extends 360° in circumference. Further, for example, an outer periphery of the substantially ring-shaped member 20 is substantially circular-shaped, and an inner periphery of the substantially ring-shaped member 20 is substantially circular-shaped. In an alternative embodiment, an outer periphery of the substantially ring-shaped member 20 is substantially oval-shaped, and an inner periphery of the substantially ring-shaped member 20 is substantially oval-shaped. Further, the substantially ring-shaped member 20 is sized to receive a human being (e.g., the user 12) within an interior region defined by the substantially ring-shaped member 20. In an exemplary embodiment, the substantially ring-shaped member 20 has an outer diameter in a range of 24-30 inches. The substantially ring-shaped member 20 includes a first end portion 101 and a second end portion 102. The first end portion 101 is disposed proximate to the second end portion 102. Also, the substantially ring-shaped member 20 has apertures 140, 142, 144, 146, 150, 152, 154, 156, 160, 162, 164, 166 extending therethrough for receiving rivets therethrough.

Referring to FIGS. 2, 6, 8 and 9, the attachment member 31 is coupled to the first and second end portions 101, 102 of the substantially ring-shaped member 20 such that the first and second end portions 101, 102 are held in close proximity to one another. The attachment member 31 is further coupled to the protrusion member 71. The attachment member 31 includes a first tubular portion 191 and a second tubular portion 192. The first tubular portion 191 includes a first end portion 201 and a second end portion 202. The first tubular portion 191 further includes apertures 210, 214 extending through the first end portion 201, and apertures 212, 216 extending through the second end portion 202. The second tubular portion 192 is coupled to the first tubular portion 191 between the first and second end portions 201, 202, and extends substantially perpendicular to the first tubular portion 191. The first end portion 101 of the substantially ring-shaped member 20 is disposed within and coupled to the first end portion 201 of the first tubular portion 191 of the attachment member 31. Further, the second end portion 102 of the substantially ring-shaped member 20 is disposed within and coupled to the second end portion 202 of the first tubular portion 191 of the attachment member 31.

Figure 8:
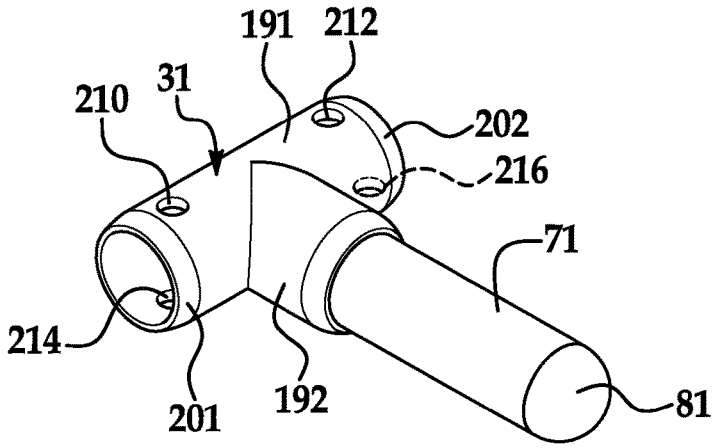
FIG. 8 is a schematic of a first attachment member, a first protrusion member, and a first tip member utilized in the muscle therapy device of FIG. 1.

Referring to FIGS. 6, 7 and 8, the rivet 40 is disposed through the aperture 210 of the attachment member 31 and the aperture 140 of the substantially ring-shaped member 20 to couple the attachment member 31 to the substantially ring-shaped member 20. Further, the rivet 42 is disposed through the aperture 212 of the attachment member 31 and the aperture 142 of the substantially ring-shaped member 20 to couple the attachment member 31 to the substantially ring-shaped member 20. Also, the rivet 44 is disposed through the aperture 214 of the attachment member 31 and the aperture 144 of the substantially ring-shaped member 20 to couple the attachment member 31 to the substantially ring-shaped member 20. Still further, the rivet 46 is disposed through the aperture 216 of the attachment member 31 and the aperture 146 of the substantially ring-shaped member 20 to couple the attachment member 31 to the substantially ring-shaped member 20.

Figure 9:
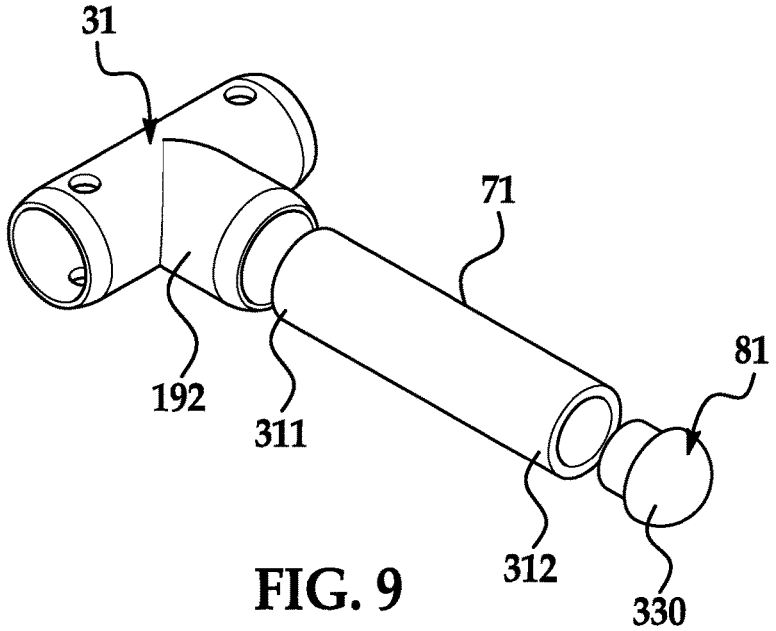
FIG. 9 is an exploded view of the first attachment member, the first protrusion member, and the first tip member of FIG. 8.

Referring to FIGS. 6, 8 and 9, the protrusion member 71 is coupled to the attachment member 31 (and indirectly coupled to the substantially ring-shaped member 20) and extends radially inwardly from the substantially ring-shaped member 20. The protrusion member 71 has a first length. The protrusion member 71 is a tubular protrusion member and includes a first end portion 311 and a second end portion 312. The first end portion 311 is coupled to the second tubular portion 192 of the attachment member 31. In particular, the first end portion 311 is disposed within the second tubular portion 192 and is adhesively bonded to the second tubular portion 192. In an exemplary embodiment, the protrusion member 71 is constructed of plastic. Of course, in an alternative embodiment, the protrusion member 71 could be constructed of other materials such as a metal for example.

Figure 10:
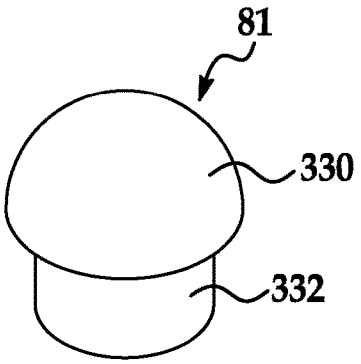
FIG. 10 is an enlarged schematic of the first tip member of FIG. 8.
Figure 11:
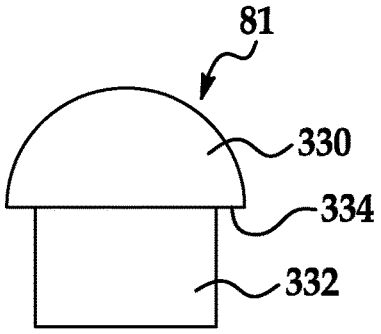
FIG. 11 is a side view of the first tip member of FIG. 8.

Referring to FIGS. 9-11, the tip member 81 is coupled to the protrusion member 71. In an exemplary embodiment, the tip member 81 includes a semi-spherical tip portion 330 and a shaft portion 332. The shaft portion 332 is coupled to and extends from a flat surface 334 of the semi-spherical tip portion 330. The semi-spherical tip portion 330 is a dome-shaped portion. The shaft portion 332 is disposed in an interior region of the second end portion 312 of the protrusion member 71 such that the semi-spherical tip portion 330 is disposed external of the protrusion member 71. In an exemplary embodiment, the shaft portion 332 is adhesively bonded to the protrusion member 71. Further, in an exemplary embodiment, a diameter of the semi-spherical tip portion 330 is substantially equal to a diameter of the protrusion member 71. Further, the tip member 81 is constructed of plastic. In an alternative embodiment, the tip member 81 could be constructed of other materials such as a rubber compound for example.

Referring to FIGS. 2, 6, 12 and 13, the attachment member 32 is coupled to the substantially ring-shaped member 20 and is further coupled to the protrusion member 72. The attachment member 32 includes a first tubular portion 231 and a second tubular portion 232. The first tubular portion 231 includes a first end portion 241 and a second end portion 242. The first tubular portion 231 further includes apertures 250, 254 extending through the first end portion 241, and apertures 252, 256 extending through the second end portion 242. The second tubular portion 232 is coupled to the first tubular portion 231 between the first and second end portions 241, 242, and extends substantially perpendicular to the first tubular portion 231. The substantially ring-shaped member 20 extends through the first tubular portion 231.

Figure 12:
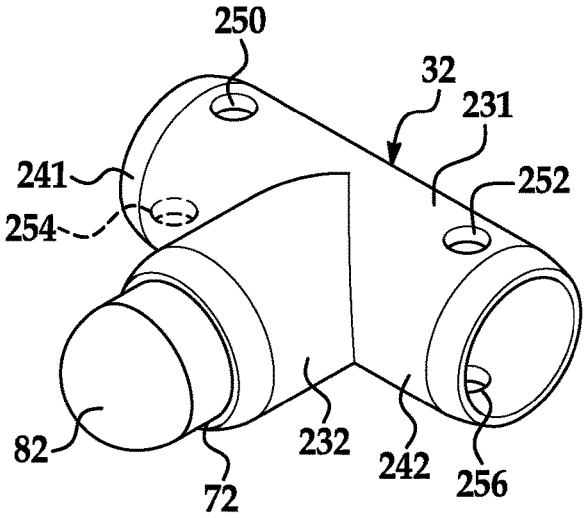
FIG. 12 is a schematic of a second attachment member, a second protrusion member, and a second tip member utilized in the muscle therapy device of FIG. 1.
Figure 13:
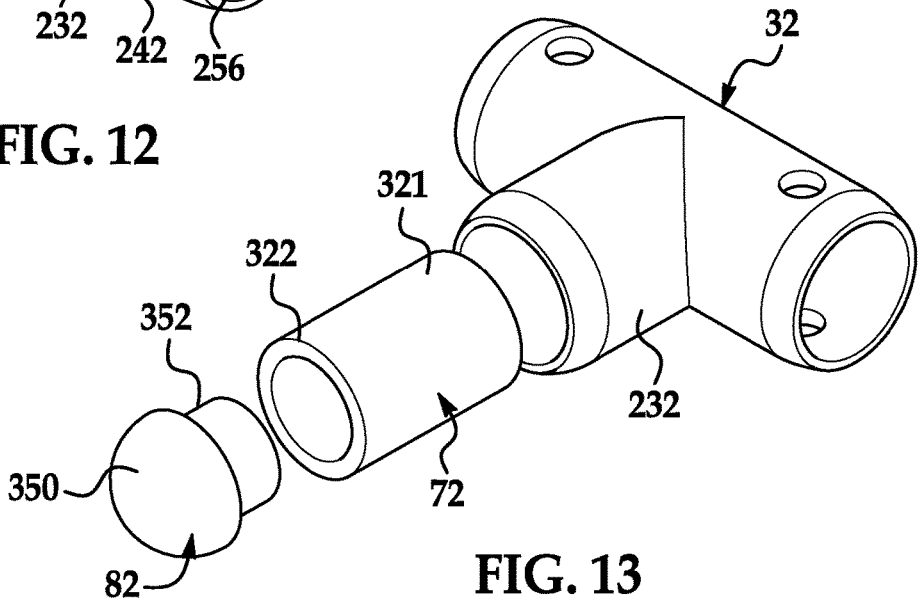
FIG. 13 is an exploded view of the second attachment member, the second protrusion member, and the second tip member of FIG. 12.

Referring to FIGS. 6, 12 and 13, the rivet 50 is disposed through the aperture 250 of the attachment member 32 and the aperture 150 of the substantially ring-shaped member 20 to couple the attachment member 32 to the substantially ring-shaped member 20. Further, the rivet 52 is disposed through the aperture 252 of the attachment member 32 and the aperture 152 of the substantially ring-shaped member 20 to couple the attachment member 32 to the substantially ring-shaped member 20. Also, the rivet 54 is disposed through the aperture 254 of the attachment member 32 and the aperture 164 of the substantially ring-shaped member 20 to couple the attachment member 32 to the substantially ring-shaped member 20. Still further, the rivet 56 is disposed through the aperture 256 of the attachment member 32 and the aperture 166 of the substantially ring-shaped member 20 to couple the attachment member 32 to the substantially ring-shaped member 20.

The protrusion member 72 is coupled to the attachment member 32 (and indirectly coupled to the substantially ring-shaped member 20) and extends radially inwardly from the substantially ring-shaped member 20. The protrusion member 72 has a second length that is less than the first length of the protrusion member 71 (shown in FIG. 8). The protrusion member 72 is a tubular protrusion member and includes a first end portion 321 and a second end portion 322. The first end portion 321 is coupled to the second tubular portion 232 of the attachment member 32. In particular, the first end portion 321 is disposed within the second tubular portion 232 and is adhesively bonded to the second tubular portion 232. In an exemplary embodiment, the protrusion member 72 is constructed of plastic. Of course, in an alternative embodiment, the protrusion member 72 could be constructed of other materials such as a metal for example.

Referring to FIG. 13, the tip member 82 is coupled to the protrusion member 72. In an exemplary embodiment, the tip member 82 includes a semi-spherical tip portion 350 and a shaft portion 352. The shaft portion 352 is coupled to and extends from a flat surface of the semi-spherical tip portion 350. The semi-spherical tip portion 350 is a dome-shaped portion. The shaft portion 352 is disposed in an interior region of the second end portion 322 of the protrusion member 72 such that the semi-spherical tip portion 350 is disposed external of the protrusion member 72. In an exemplary embodiment, the shaft portion 352 is adhesively bonded to the protrusion member 72. Further, in an exemplary embodiment, a diameter of the semi-spherical tip portion 350 is substantially equal to a diameter of the protrusion member 72. In an exemplary embodiment, the tip member 82 is constructed of plastic. In an alternative embodiment, the tip member 82 could be constructed of other materials such as a rubber compound for example.

Figure 14:
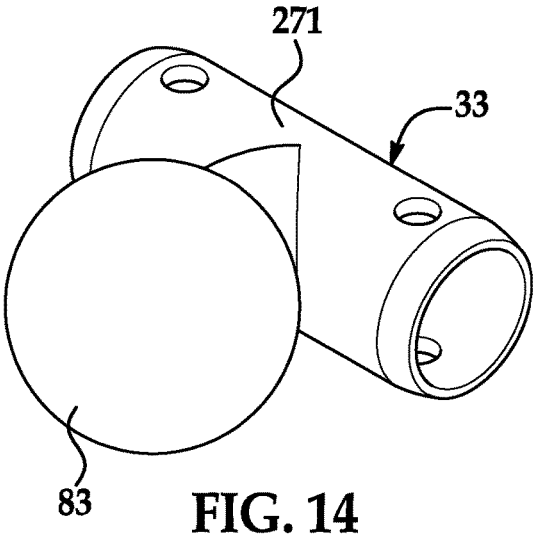
FIG. 14 is a schematic of a third attachment member and a third tip member utilized in the muscle therapy device of FIG. 1.
Figure 15:
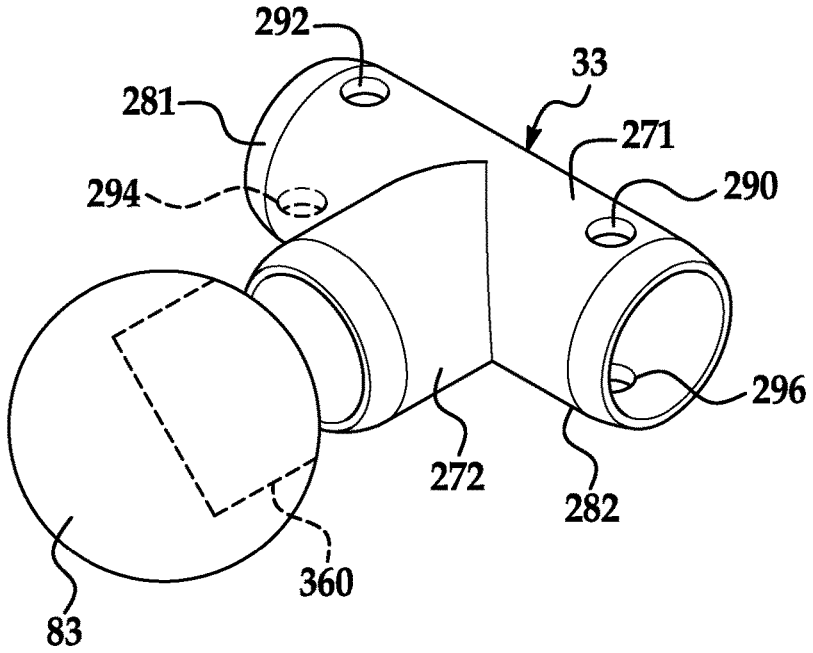
FIG. 15 is an exploded view of the third attachment member and the third tip member of FIG. 14.

Referring to FIGS. 6, 14 and 15, the attachment member 33 is coupled to the substantially ring-shaped member 20 and is further coupled to the tip member 83. The attachment member 33 includes a first tubular portion 271 and a second tubular portion 272. The first tubular portion 271 includes a first end portion 281 and a second end portion 282. The first tubular portion 271 further includes apertures 292, 294 extending through the first end portion 281, and apertures 290, 296 extending through the second end portion 282. The second tubular portion 272 is coupled to the first tubular portion 271 between the first and second end portions 281, 282, and extends substantially perpendicular to the first tubular portion 271. The substantially ring-shaped member 20 extends through the first tubular portion 271.

Referring to FIGS. 6, 7 and 15, the rivet 60 is disposed through the aperture 290 of the attachment member 33 and the aperture 160 of the substantially ring-shaped member 20 to couple the attachment member 33 to the substantially ring-shaped member 20. Further, the rivet 62 is disposed through the aperture 292 of the attachment member 33 and the aperture 162 of the substantially ring-shaped member 20 to couple the attachment member 33 to the substantially ring-shaped member 20. Also, the rivet 64 is disposed through the aperture 296 of the attachment member 33 and the aperture 154 of the substantially ring-shaped member 20 to couple the attachment member 33 to the substantially ring-shaped member 20. Still further, the rivet 66 is disposed through the aperture 294 of the attachment member 33 and the aperture 154 of the substantially ring-shaped member 20 to couple the attachment member 33 to the substantially ring-shaped member 20.

Referring to FIGS. 14 and 15, the tip member 83 is coupled to the second tubular portion 272. In an exemplary embodiment, the tip member 83 is a spherical cap shaped tip member having an aperture 360 extending therein. The second tubular portion 272 of the attachment member 33 is disposed within the aperture 360. In an exemplary embodiment, the attachment member 33 is adhesively bonded to the tip member 83. A diameter of the tip member 83 is greater than a diameter of the semi-spherical tip portion 350 (shown in FIG. 13) of the tip member 82. Also, the diameter of the tip member 83 is greater than a diameter of the semi-spherical tip portion 330 (shown in FIG. 9) of the tip member 81. In an exemplary embodiment, the tip member 83 is constructed of plastic. In an alternative embodiment, the tip member 83 could be constructed of other materials such as a rubber compound for example.

Figure 3:
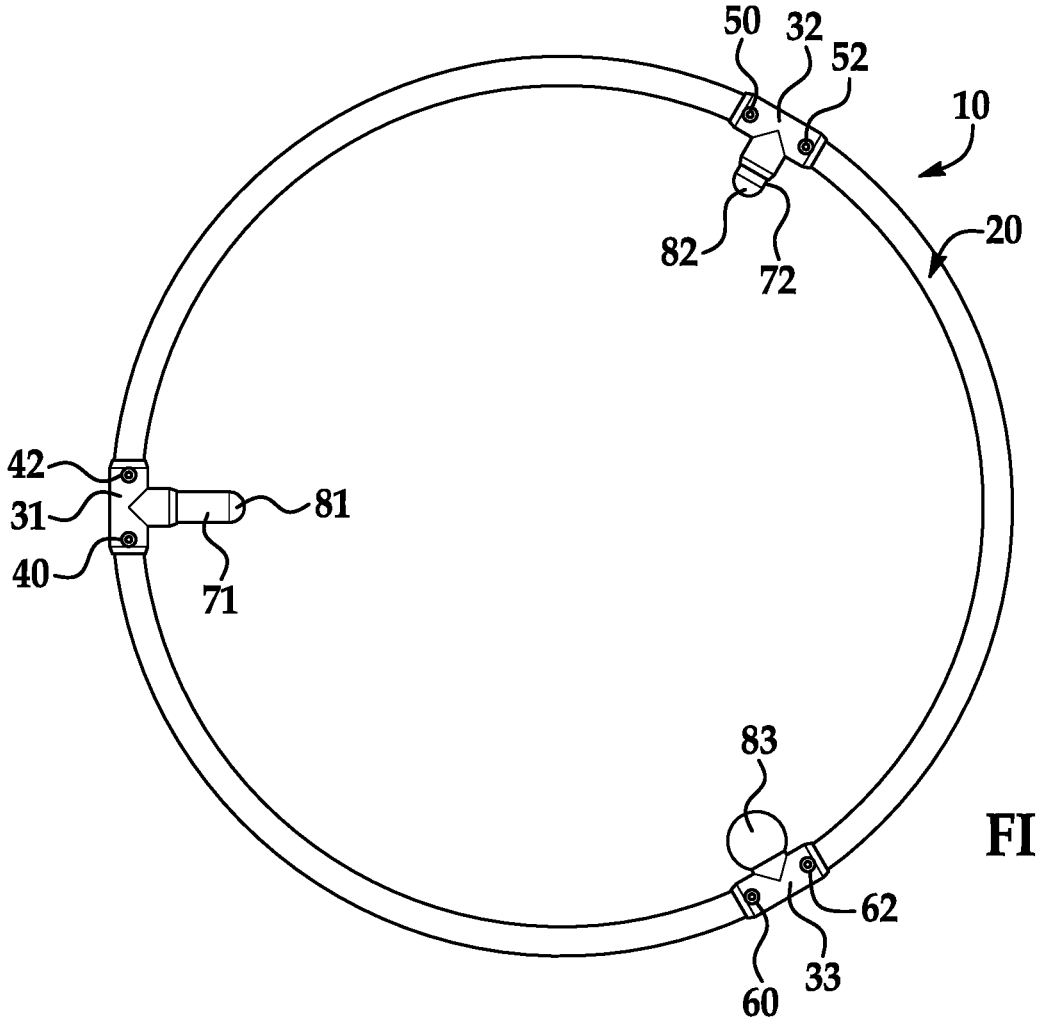
FIG. 3 is a schematic of a first side of the muscle therapy device of FIG. 1.
Figure 4:
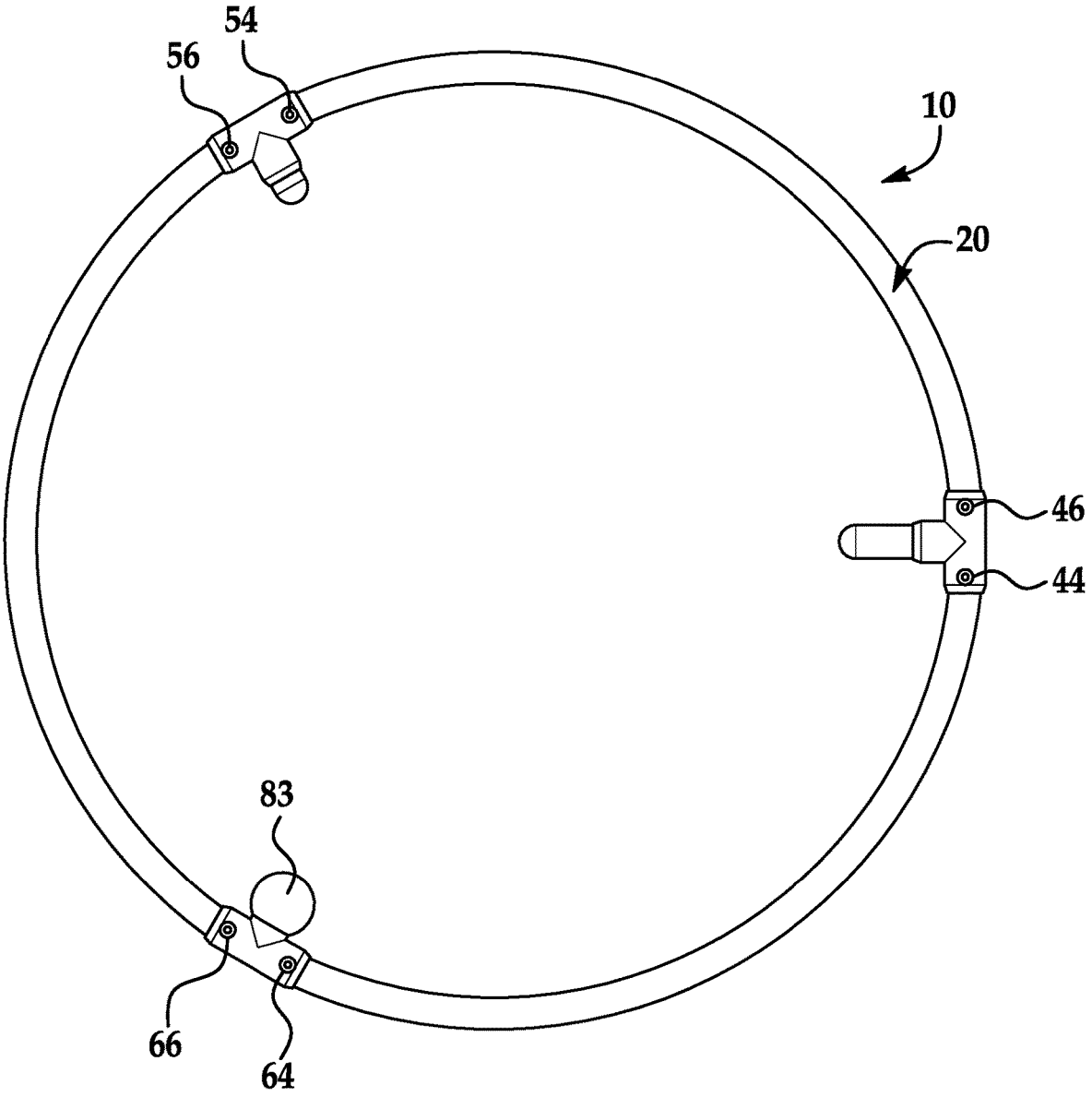
FIG. 4 is a schematic of a second side of the muscle therapy device of FIG. 1.
Figure 5:
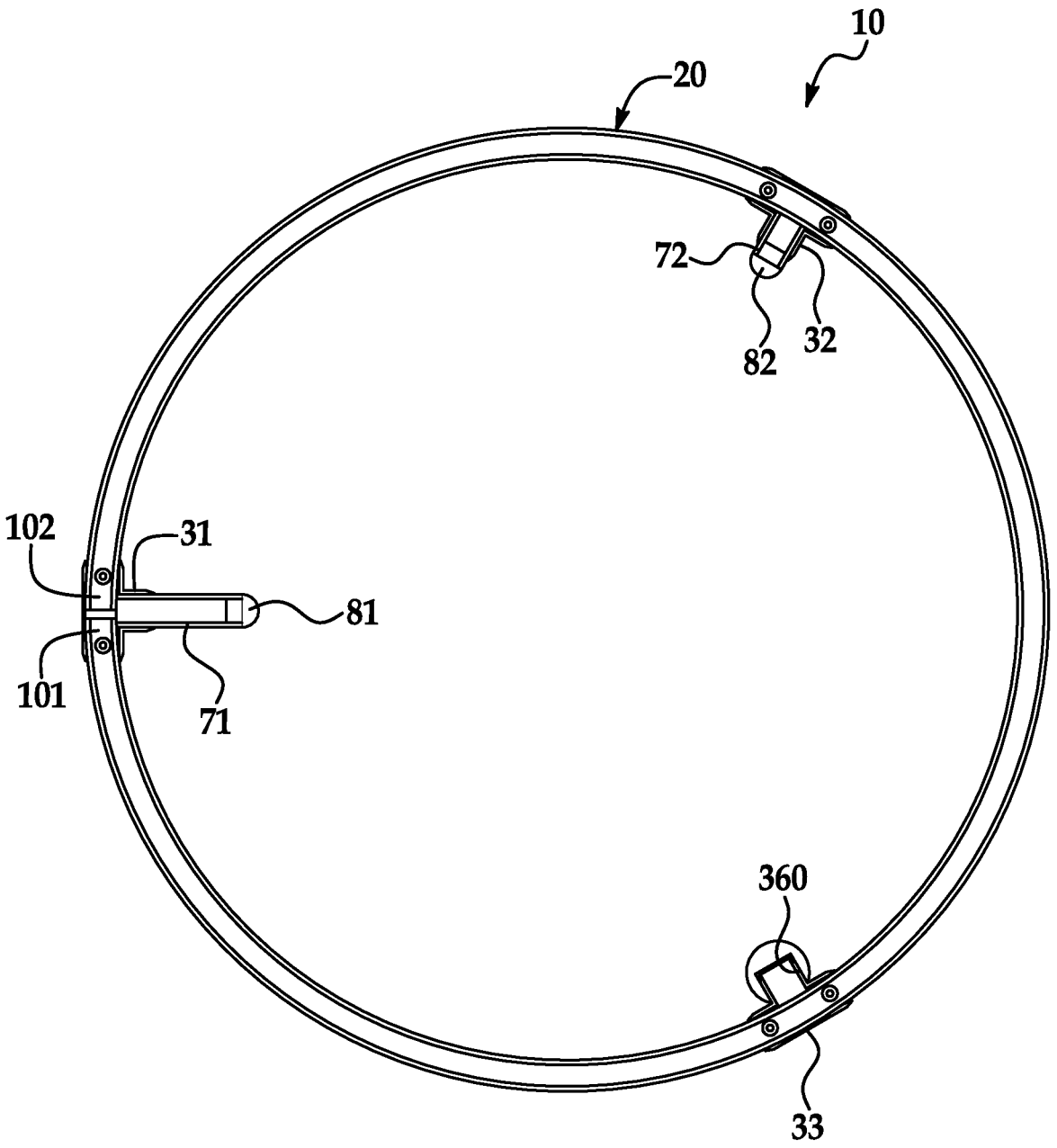
FIG. 5 is a cross-sectional schematic of the muscle therapy device of FIG. 1.

Referring to FIG. 3, the attachment members 31, 32 are spaced substantially 120 degrees apart from one another, and attachment members 32, 33 are spaced substantially 120 degrees apart from one another, and the attachment members 33, 31 are spaced substantially 120 degrees apart from one another.

Figure 16:
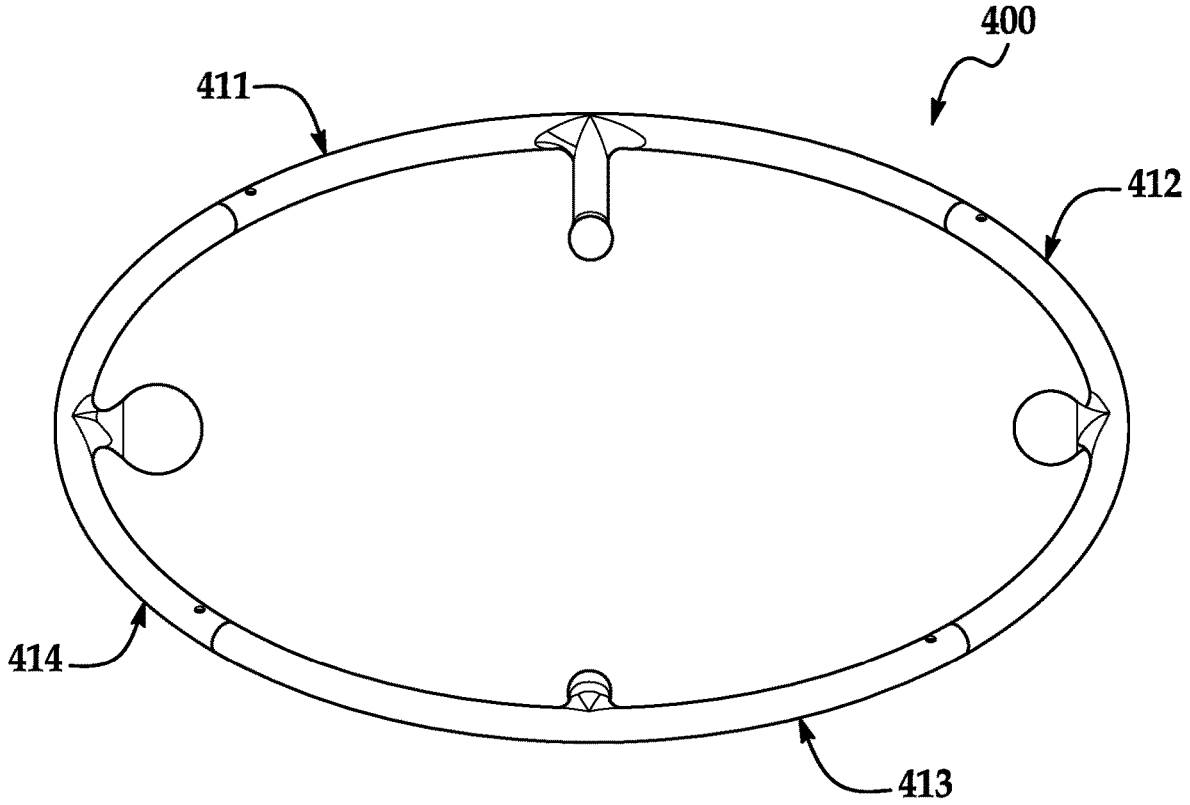
FIG. 16 is a schematic of a muscle therapy device in accordance with a second exemplary embodiment.
Figure 17:
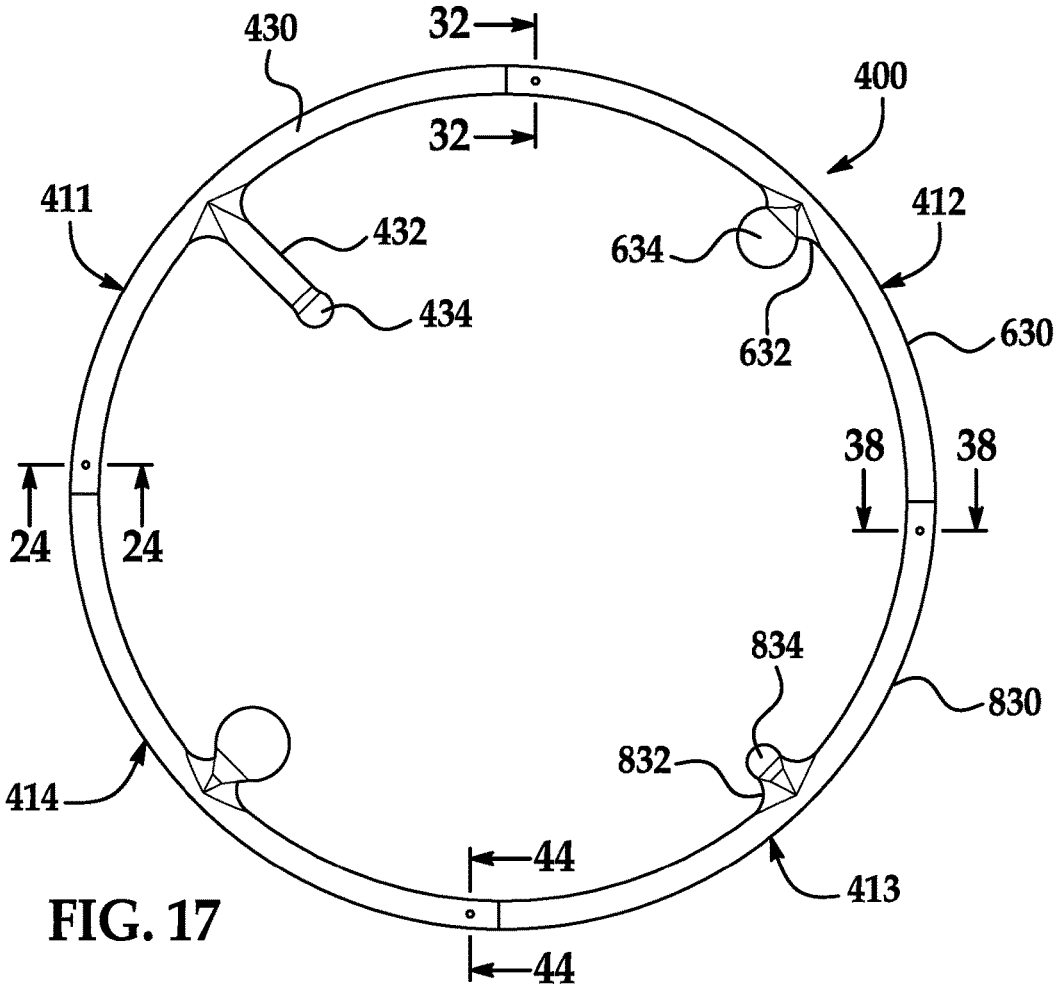
FIG. 17 is a schematic of a first side of the muscle therapy device of FIG. 16.
Figure 18:
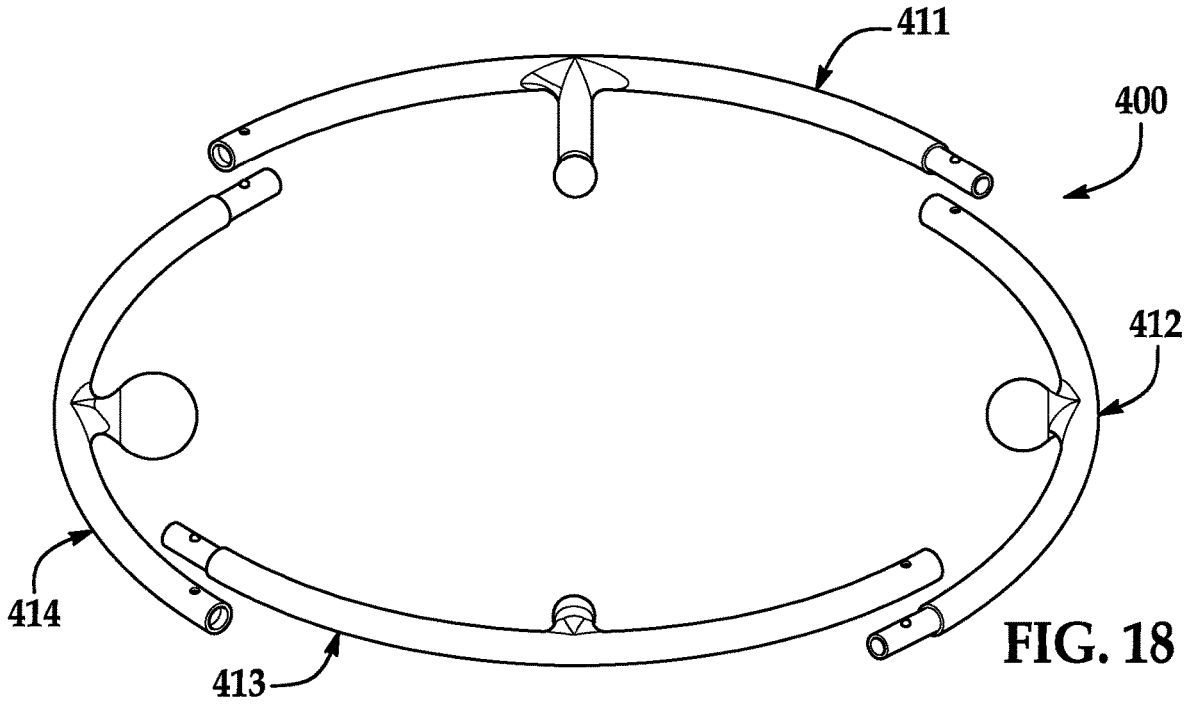
FIG. 18 is an exploded view of the muscle therapy device of FIG. 16.

Referring to FIGS. 16-18, a muscle therapy device 400 that could be utilized by user 12 for muscle therapy treatments, in accordance with another exemplary embodiment is provided. The muscle therapy device 400 includes a first member 411, a second member 412, a third member 413, and a fourth member 414. The first member 411 is removably coupled to and between the second member 412 and the fourth member 414. Further, the third member 413 is removably coupled to and between the second member 412 and the fourth member 414.

Referring to FIGS. 17 and 19-24, the first member 411 includes an arcuate-shaped portion 430, a protrusion member 432, and a tip member 434. In an exemplary embodiment, the protrusion member 432 is integrally formed with the arcuate-shaped portion 430, and the tip member 434 is integrally formed with the protrusion member 432.

The arcuate-shaped portion 430 includes a main tubular portion 450, a coupling tip 452, and a button connector 454.

The main tubular portion 450 is constructed of plastic and has a first end 461 and a second end 462. The main tubular portion 450 has an aperture 466 extending therethrough proximate to the second end 462 thereof. The second end 462 of the main tubular portion 450 has first and second internal grooves 480, 482 (shown in FIG. 24) extending from an interior surface of the main tubular portion 450 into the main tubular portion 450.

Figure 22:
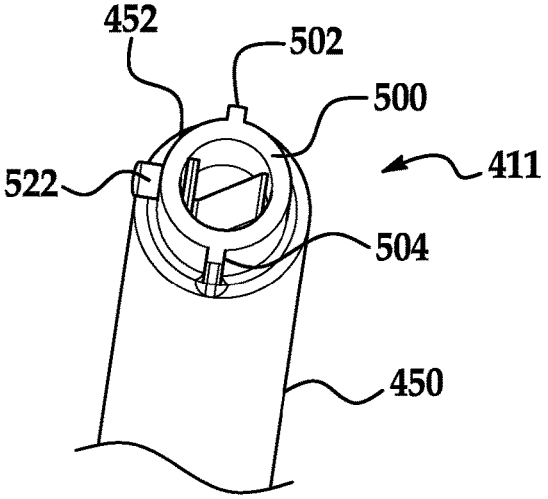
FIG. 22 is a schematic of a coupling tip and a main tubular portion of the first member of FIG. 19.

Referring to FIG. 22, the coupling tip 452 is constructed of plastic and is coupled to and extends from the first end 461 of the main tubular portion 450. The coupling tip 452 has a tubular wall 500 and tabs 502, 504 extending outwardly from the tubular wall 500.

Referring to FIGS. 16, 20 and 23-26, the button connector 454 is provided to removably couple the first member 411 to the second member 412. The button connector 454 has a v-shaped body 520 and a button tab 522 coupled to the v-shaped body 520. The v-shaped body 520 is disposed within the coupling tip 452 such that the button tab 522 extends through the aperture 508 (shown in FIG. 23) of the tubular wall 500 of the coupling tip 452 and is exposed external to the coupling tip 452. The button tab 522 is depressed when coupling the first member 411 to the second member 412. In an exemplary embodiment, the button connector 454 is constructed of spring steel.

Figure 19:
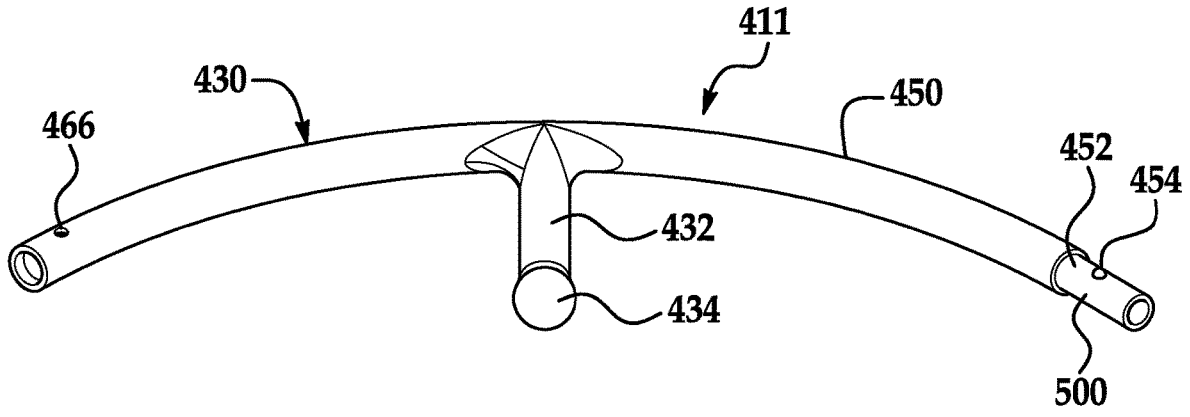
FIG. 19 is a schematic of a first member utilized in the muscle therapy device of FIG. 16.
Figure 20:
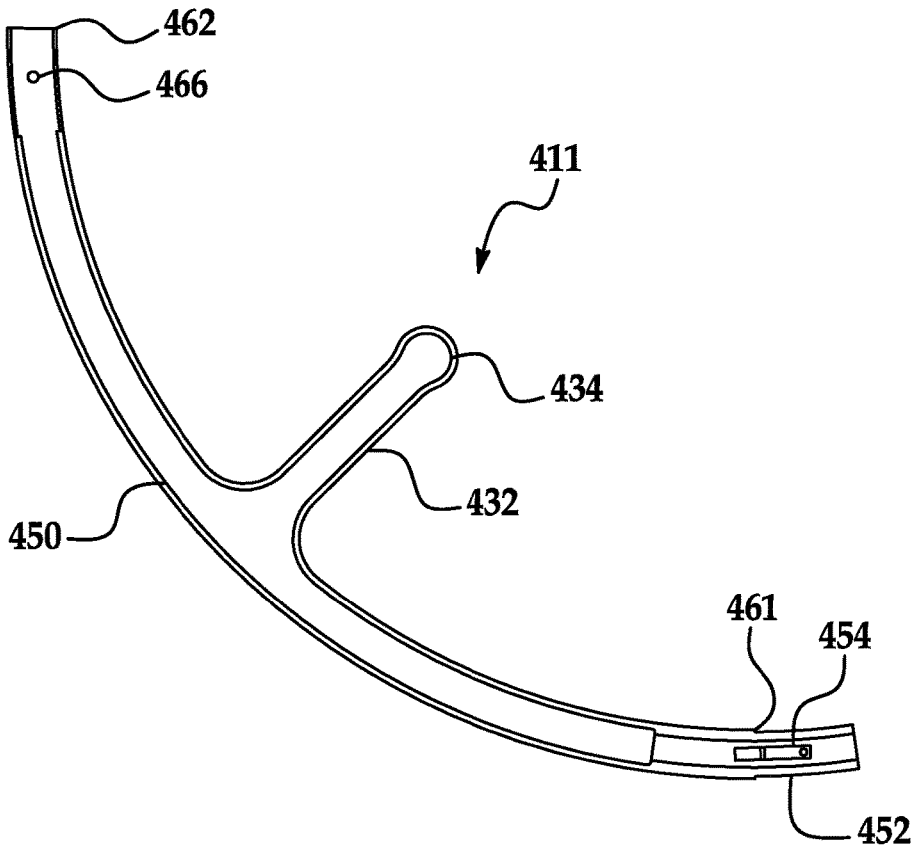
FIG. 20 is a cross-sectional schematic of the first member of FIG. 19.
Figure 21:
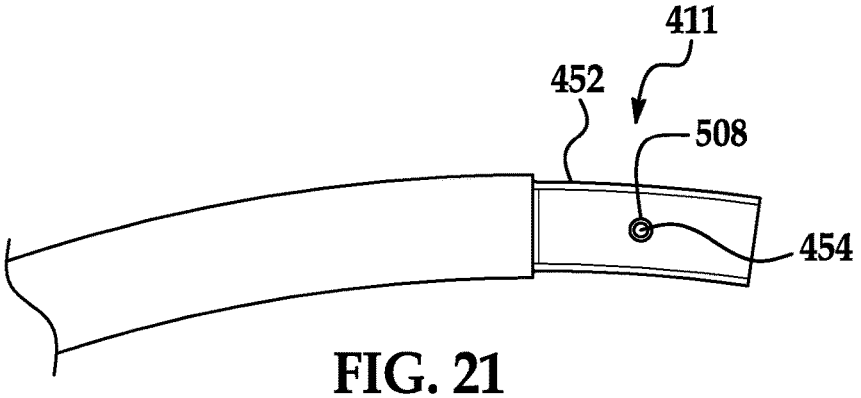
FIG. 21 is a schematic of an end portion of the first member of FIG. 19.

Referring to FIGS. 19 and 20, the protrusion member 432 is constructed of plastic and is coupled to the arcuate-shaped portion 430 and extends radially inwardly from the arcuate-shaped portion 430. In an exemplary embodiment, the protrusion member 432 is a tubular member. The protrusion member 432 has a first length.

The tip member 434 is disposed and coupled to a distal end of the protrusion member 432. A diameter of the tip member 434 is greater than a diameter of the protrusion member 432. The tip member 434 could be constructed of plastic or a rubber compound.

Referring to FIGS. 17 and 27-32, the second member 412 includes an arcuate-shaped portion 630, a protrusion member 632, and a tip member 634. In an exemplary embodiment, the protrusion member 632 is integrally formed with the arcuate-shaped portion 630, and the tip member 634 is integrally formed with the protrusion member 632.

The arcuate-shaped portion 630 includes a main tubular portion 650, a coupling tip 652, and a button connector 654.

The main tubular portion 650 is constructed of plastic and has a first end 661 and a second end 662. The main tubular portion 650 has an aperture 666 extending therethrough proximate to the second end 662 thereof. The second end 662 of the main tubular portion 650 has first and second internal grooves 680, 682 (shown in FIG. 32) extending from an interior surface of the main tubular portion 650 into the main tubular portion 650.

Figure 30:
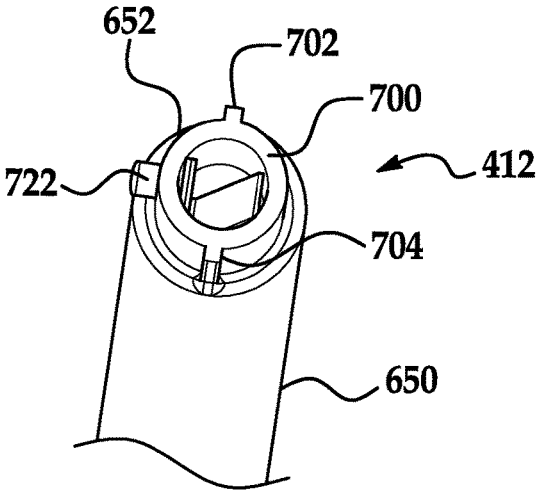
FIG. 30 is a schematic of a coupling tip and a main tubular portion of the second member of FIG. 27.

Referring to FIG. 30, the coupling tip 652 is constructed of plastic and is coupled to and extends from the first end 661 of the main tubular portion 650. The coupling tip 652 has a tubular wall 700 and tabs 702, 704 extending outwardly from the tubular wall 700.

Figure 28:
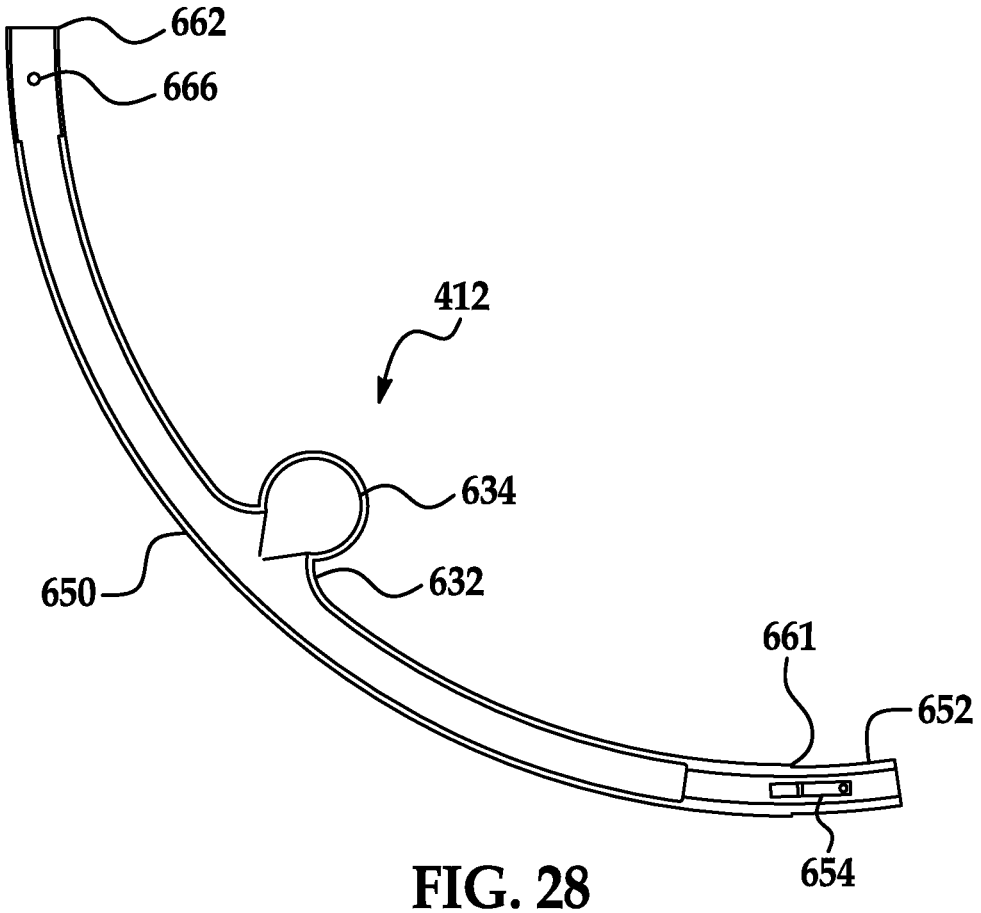
FIG. 28 is a cross-sectional schematic of the second member of FIG. 27.
Figure 29:
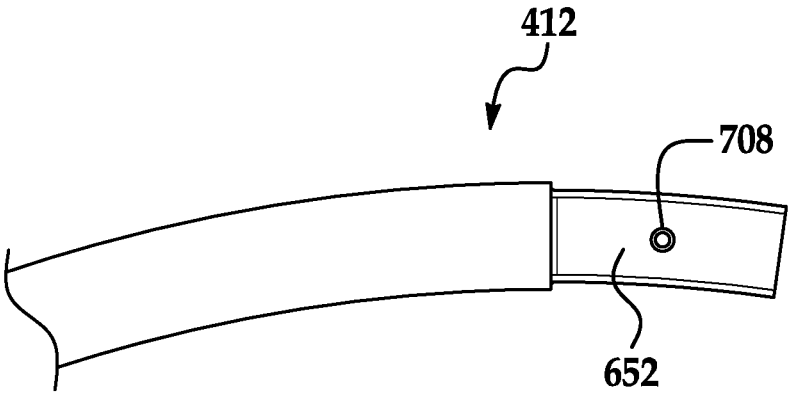
FIG. 29 is a schematic of an end portion of the second member of FIG. 27.
Figure 31:
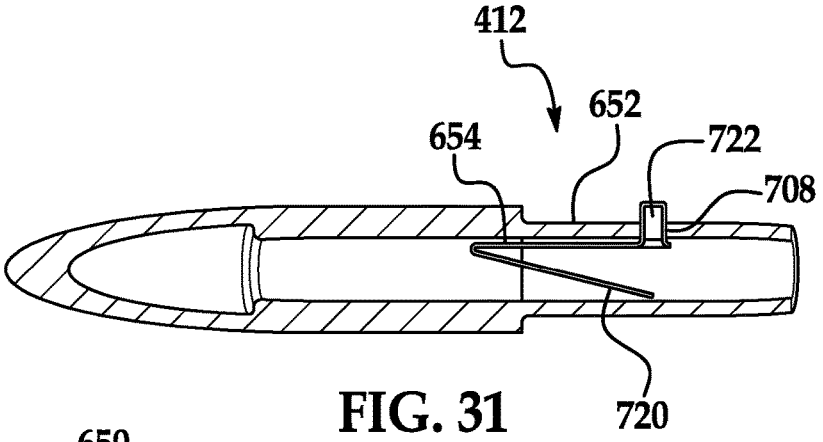
FIG. 31 is a cross-sectional schematic of the coupling tip and the main tubular portion of the second member of FIG. 27.
Figure 32:
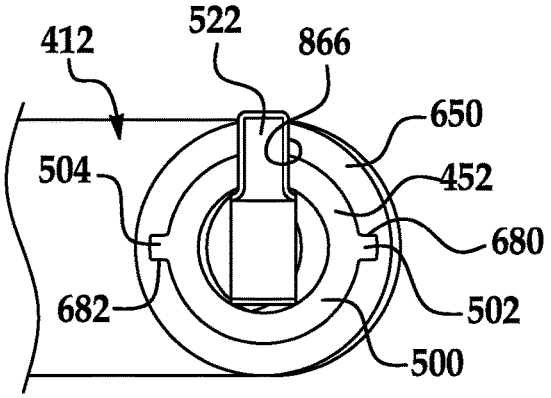
FIG. 32 is a cross-sectional schematic of the muscle therapy device of FIG. 17 taken along lines 32-32 in FIG. 17.

Referring to FIGS. 28, 31 and 32, the button connector 654 is provided to removably couple the second member 412 to the third member 413. The button connector 654 has a v-shaped body 720 and a button tab 722 coupled to the v-shaped body 720. The v-shaped body 720 is disposed within the coupling tip 652 such that the button tab 722 extends through the aperture 708 (shown in FIG. 29) of the tubular wall 700 of the coupling tip 652 and is exposed external to the coupling tip 652. The button tab 722 is depressed when coupling the second member 412 to the third member 413. In an exemplary embodiment, the button connector 654 is constructed of spring steel.

Figure 27:
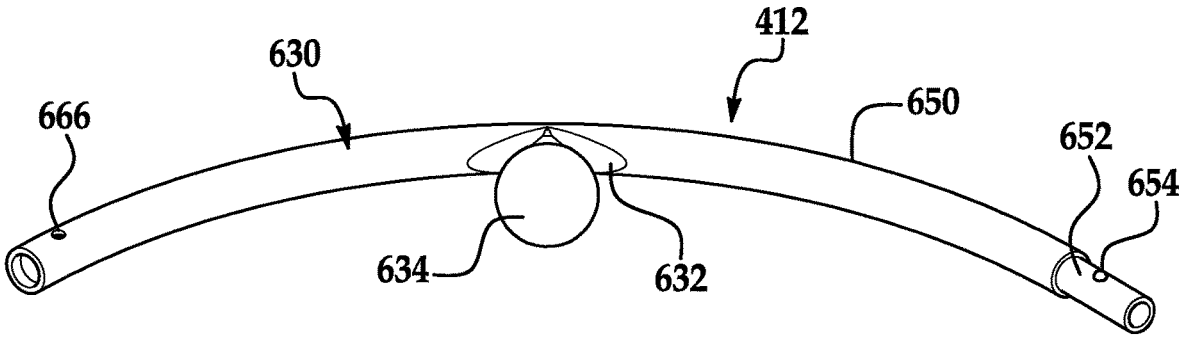
FIG. 27 is a schematic of a second member utilized in the muscle therapy device of FIG. 16.

Referring to FIGS. 27 and 28, the protrusion member 632 is constructed of plastic and is coupled to the arcuate-shaped portion 630 and extends radially inwardly from the arcuate-shaped portion 630. In an exemplary embodiment, the protrusion member 632 is a tubular member. The protrusion member 632 has a second length which is less than the first length of the protrusion member 432 (shown in FIG. 20).

The tip member 634 is disposed and coupled to a distal end of the protrusion member 632. A diameter of the tip member 634 is greater than a diameter of the protrusion member 632. The tip member 634 could be constructed of plastic or a rubber compound.

Figure 23:
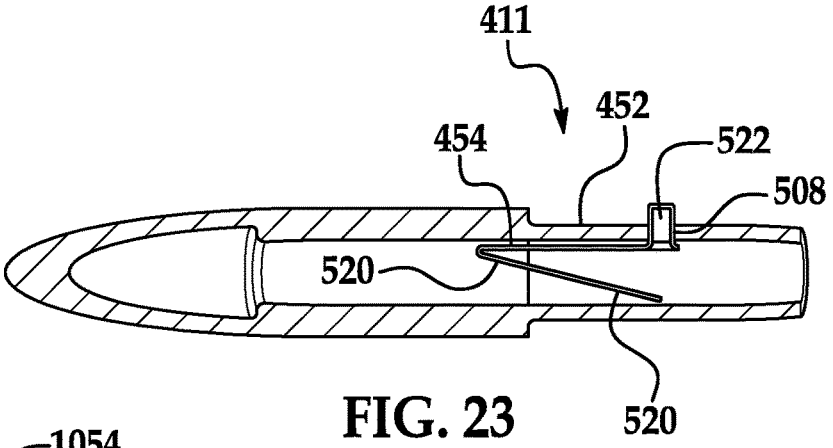
FIG. 23 is a cross-sectional schematic of the coupling tip and the main tubular portion of FIG. 22.

Referring to FIGS. 23 and 32, a brief description of the coupling of the second member 412 to the first member 411 will be explained. The coupling tip 452 of the first member 411 is inserted into the main tubular portion 650 of the arcuate-shaped portion 630 of the second member 412 such that the tabs 502, 504 of the coupling tip 452 of the first member 411 are received in the internal grooves 680, 682 of the main tubular portion 650 of the arcuate-shaped portion 630 of the second member 412. Further, the button tab 522 of the first member 411 is depressed during the insertion of the coupling tip 452 into the main tubular portion 650, and thereafter is biased through the aperture 866 of the main tubular portion 650 of the arcuate-shaped portion 630 of the second member 412—to couple the second member 412 to the first member 411.

Referring to FIGS. 17 and 33-38, the third member 413 includes an arcuate-shaped portion 830, a protrusion member 832, and a tip member 834. In an exemplary embodiment, the protrusion member 832 is integrally formed with the arcuate-shaped portion 830, and the tip member 834 is integrally formed with the protrusion member 832.

The arcuate-shaped portion 830 includes a main tubular portion 850, a coupling tip 852, and a button connector 854.

The main tubular portion 850 is constructed of plastic and has a first end 861 and a second end 862. The main tubular portion 850 has an aperture 866 extending therethrough proximate to the second end 862 thereof. The second end 862 of the main tubular portion 850 has first and second internal grooves 880, 882 (shown in FIG. 38) extending from an interior surface of the main tubular portion 850 into the main tubular portion 850.

Figure 36:
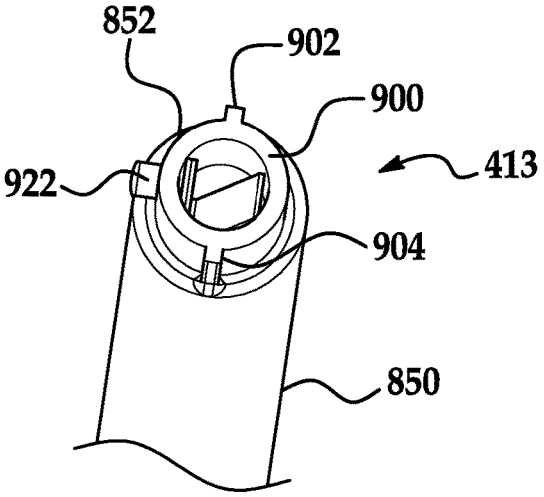
FIG. 36 is a schematic of a coupling tip and a main tubular portion of the third member of FIG. 33.

Referring to FIG. 36, the coupling tip 852 is constructed of plastic and is coupled to and extends from the first end 861 of the main tubular portion 850. The coupling tip 852 has a tubular wall 900 and tabs 902, 904 extending outwardly from the tubular wall 900.

Figure 34:
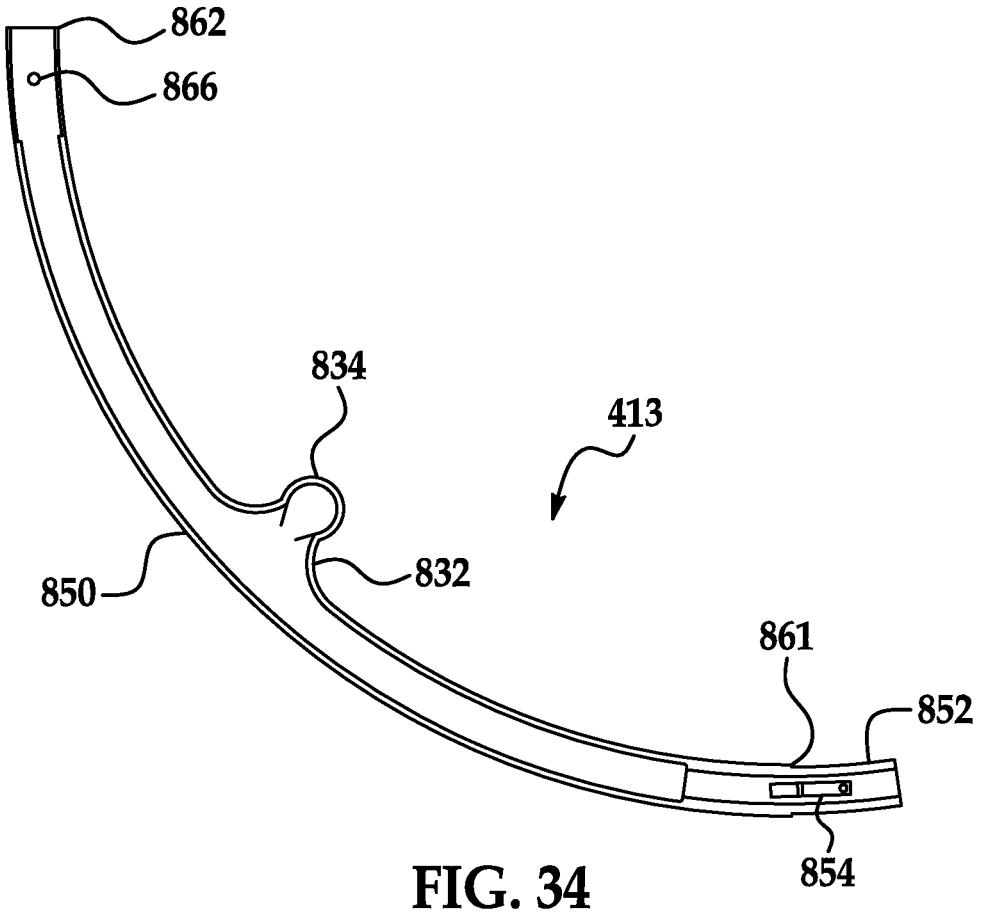
FIG. 34 is a cross-sectional schematic of the third member of FIG. 33.
Figure 35:
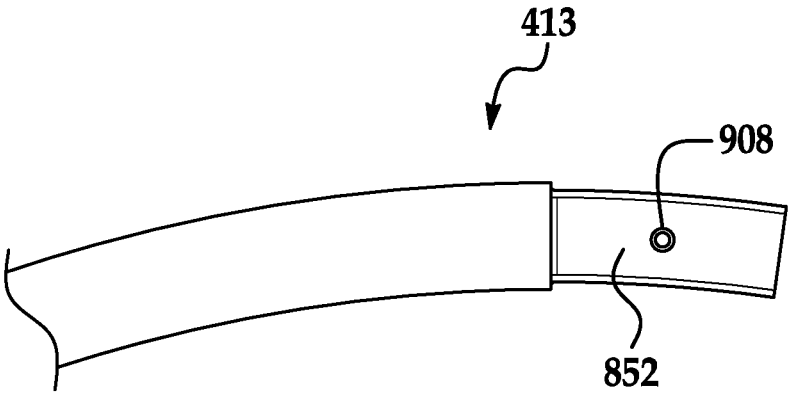
FIG. 35 is a schematic of an end portion of the third member of FIG. 33.
Figure 37:
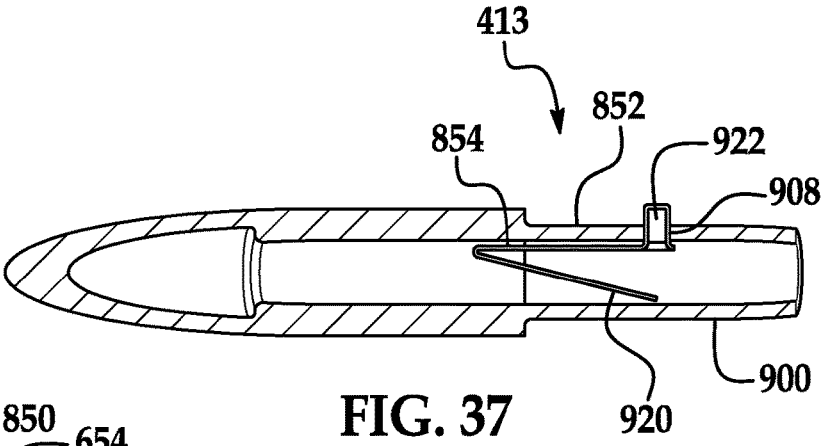
FIG. 37 is a cross-sectional schematic of the coupling tip and the main tubular portion of the third member of FIG. 33.

Referring to FIGS. 34 and 37, the button connector 854 is provided to removably couple the third member 413 to the fourth member 414. The button connector 854 has a v-shaped body 920 and a button tab 922 coupled to the v-shaped body 920. The v-shaped body 920 is disposed within the coupling tip 852 such that the button tab 922 extends through the aperture 908 (shown in FIG. 37) of the tubular wall 900 of the coupling tip 852 and is exposed external to the coupling tip 852. The button tab 922 is depressed when coupling the third member 413 to the fourth member 414. In an exemplary embodiment, the button connector 854 is constructed of spring steel.

Figure 33:
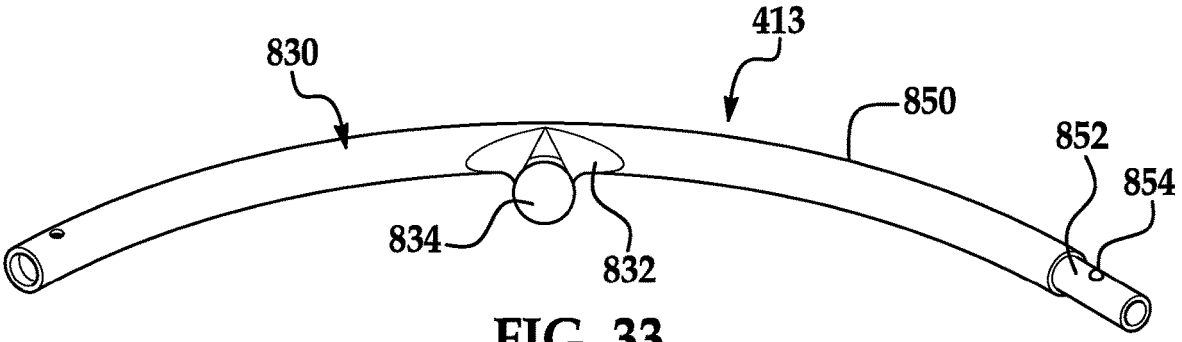
FIG. 33 is a schematic of a third member utilized in the muscle therapy device of FIG. 16.

Referring to FIGS. 33 and 34, the protrusion member 832 is constructed of plastic and is coupled to the arcuate-shaped portion 830 and extends radially inwardly from the arcuate-shaped portion 830. In an exemplary embodiment, the protrusion member 832 is a tubular member. The protrusion member 832 has a third length which is less than the first length of the protrusion member 432 (shown in FIG. 17).

The tip member 834 is disposed and coupled to a distal end of the protrusion member 832. A diameter of the tip member 834 is greater than a diameter of the protrusion member 832. The tip member 834 could be constructed of plastic or a rubber compound.

Figure 38:
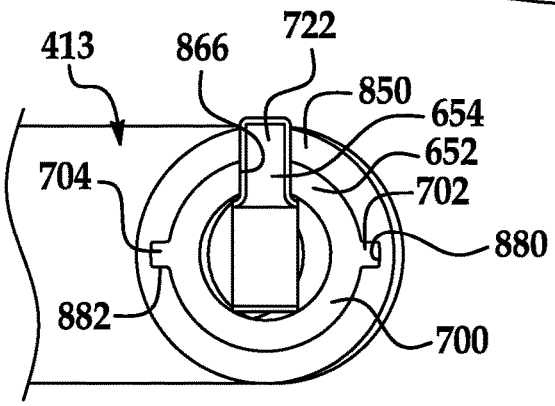
FIG. 38 is a cross-sectional schematic of the muscle therapy device of FIG. 17 taken along lines 38-38 in FIG. 17.

Referring to FIGS. 30, 31 and 38, a brief description of the coupling of the third member 413 to the second member 412 will be explained. The coupling tip 652 of the second member 412 is inserted into the main tubular portion 850 of the arcuate-shaped portion 830 of the third member 413 such that the tabs 702, 704 of the coupling tip 652 of the second member 412 are received in the internal grooves 880, 882 of the main tubular portion 850 of the arcuate-shaped portion 830 of the third member 413. Further, the button tab 722 of the second member 412 is depressed during the insertion of the coupling tip 652 into the main tubular portion 850, and thereafter is biased through the aperture 866 of the main tubular portion 850 of the arcuate-shaped portion 830 of the third member 413—to couple the third member 413 to the second member 412.

Referring to FIGS. 17 and 39-44, the fourth member 414 includes an arcuate-shaped portion 1030, a protrusion member 1032, and a tip member 1034. In an exemplary embodiment, the protrusion member 1032 is integrally formed with the arcuate-shaped portion 1030, and the tip member 1034 is integrally formed with the protrusion member 1032.

The arcuate-shaped portion 1030 includes a main tubular portion 1050, a coupling tip 1052, and a button connector 1054.

The main tubular portion 1050 is constructed of plastic and has a first end 1061 and a second end 1062. The main tubular portion 1050 has an aperture 1066 extending therethrough proximate to the second end 1062 thereof. The second end 1062 of the main tubular portion 1050 has first and second internal grooves 1080, 1082 (shown in FIG. 44) extending from an interior surface of the main tubular portion 1050 into the main tubular portion 1050.

Figure 42:
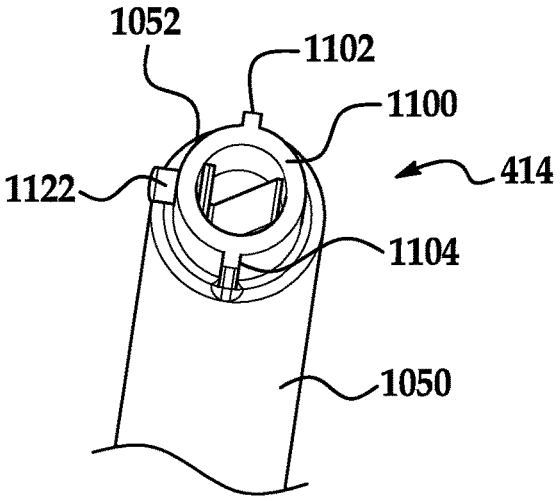
FIG. 42 is a schematic of a coupling tip and a main tubular portion of the fourth member of FIG. 39.

Referring to FIG. 42, the coupling tip 1052 is constructed of plastic and is coupled to and extends from the first end 1061 of the main tubular portion 1050. The coupling tip 1052 has a tubular wall 1100 and tabs 1102, 1104 extending outwardly from the tubular wall 1100.

Figure 40:
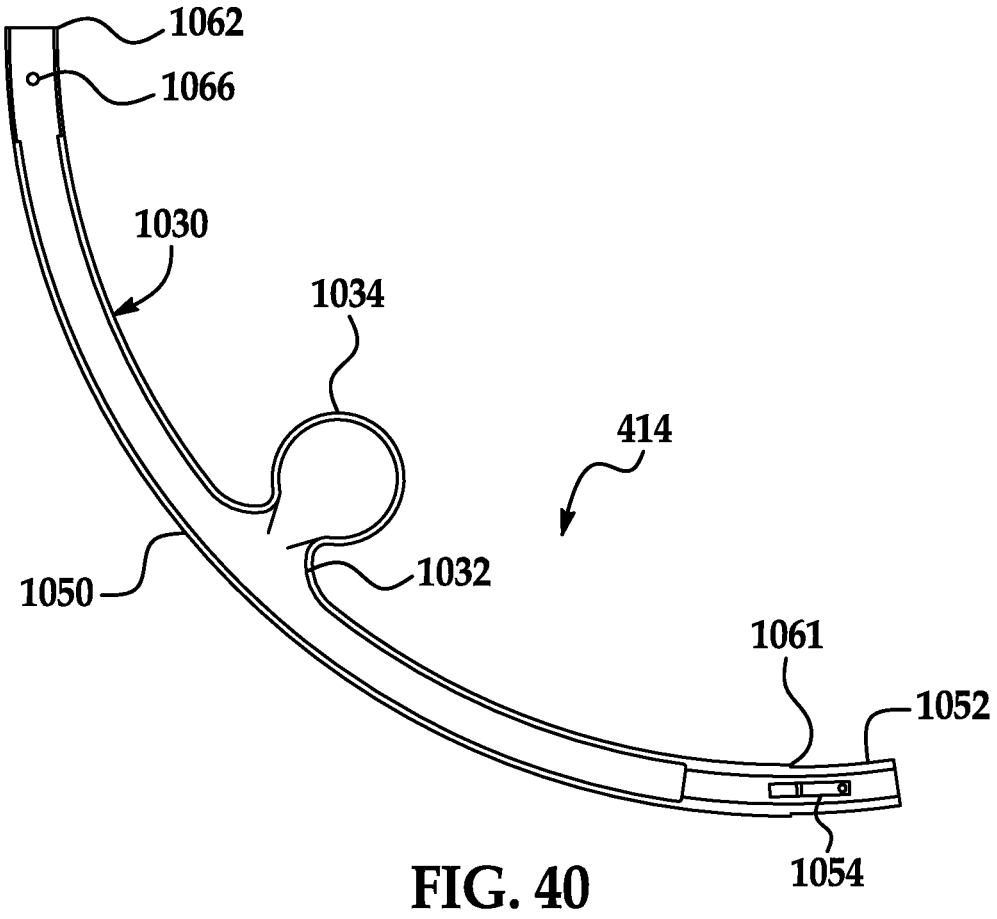
FIG. 40 is a cross-sectional schematic of the fourth member of FIG. 39.
Figure 41:
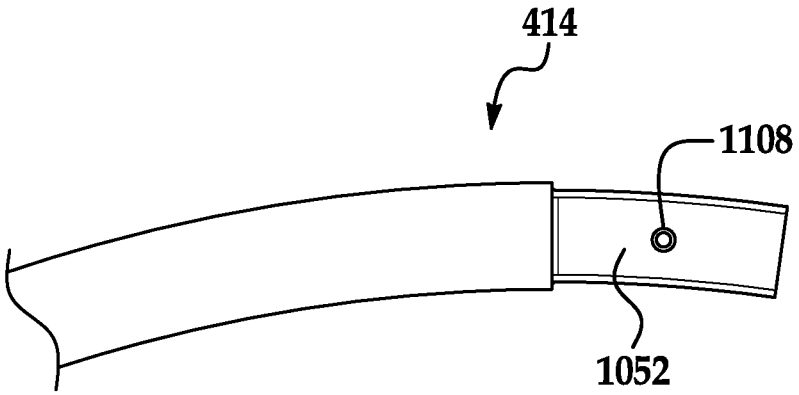
FIG. 41 is a schematic of an end portion of the fourth member of FIG. 39.
Figure 43:
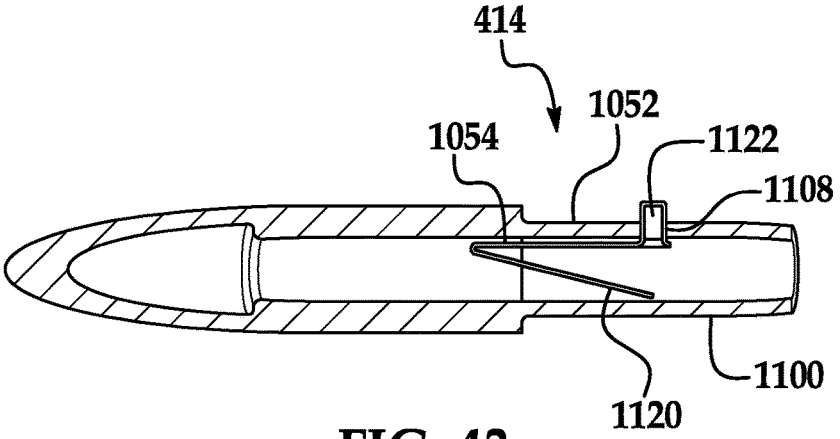
FIG. 43 is a cross-sectional schematic of the coupling tip and the main tubular portion of the fourth member of FIG. 39.

Referring to FIGS. 40 and 43, the button connector 1054 is provided to removably couple the fourth member 414 to the first member 411. The button connector 1054 has a v-shaped body 1120 and a button tab 1122 coupled to the v-shaped body 1120. The v-shaped body 1120 is disposed within the coupling tip 1052 such that the button tab 1122 extends through the aperture 1108 (shown in FIG. 43) of the tubular wall 1100 of the coupling tip 1052 and is exposed external to the coupling tip 1052. The button tab 1122 is depressed when coupling the fourth member 414 to the first member 411. In an exemplary embodiment, the button connector 1054 is constructed of spring steel.

Figure 39:
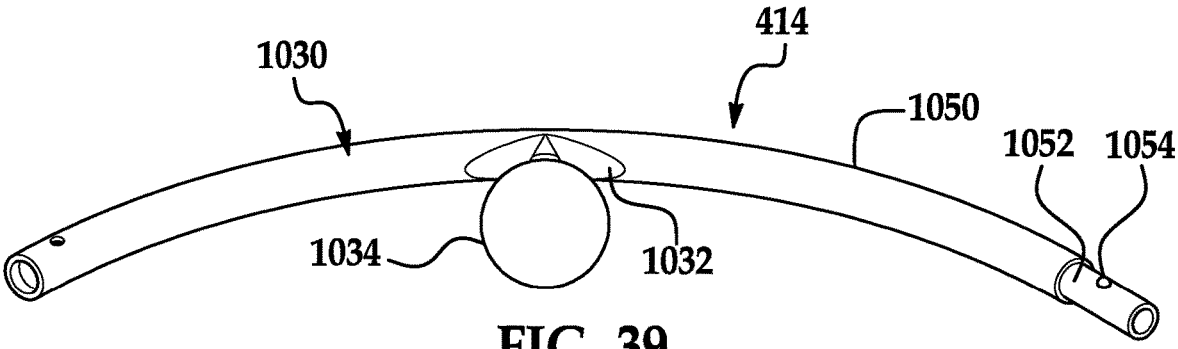
FIG. 39 is a schematic of a fourth member utilized in the muscle therapy device of FIG. 16.

Referring to FIGS. 39 and 40, the protrusion member 1032 is constructed of plastic and is coupled to the arcuate-shaped portion 1030 and extends radially inwardly from the arcuate-shaped portion 1030. In an exemplary embodiment, the protrusion member 1032 is a tubular member. The protrusion member 1032 has a fourth length which is less than the first length of the protrusion member 432 (shown in FIG. 17).

The tip member 1034 is disposed and coupled to a distal end of the protrusion member 1032. A diameter of the tip member 1034 is greater than a diameter of the protrusion member 1032. The tip member 1034 could be constructed of plastic or a rubber compound.

Figure 44:
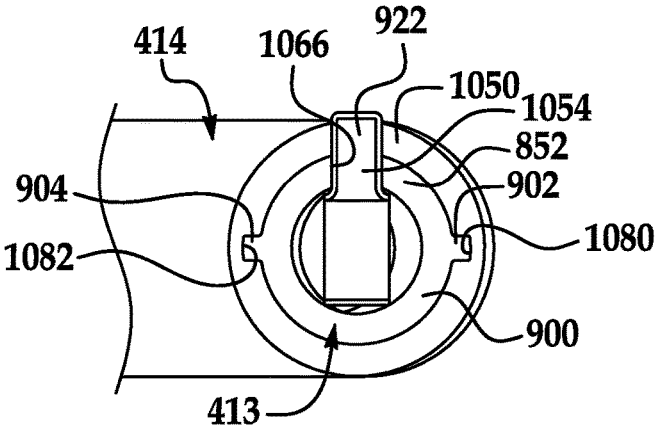
FIG. 44 is a cross-sectional schematic of the muscle therapy device of FIG. 17 taken along lines 44-44 in FIG. 17.
Figure 45:
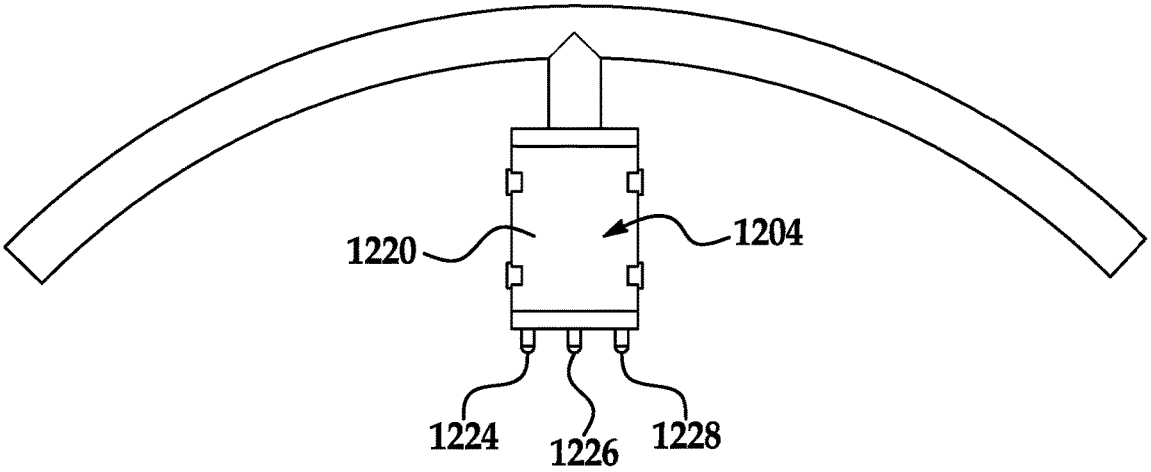
FIG. 45 is a schematic of an ultrasonic transducer assembly that could replace a tip member in the muscle therapy device of FIG. 1 or the muscle therapy device of FIG. 16.
Figure 46:
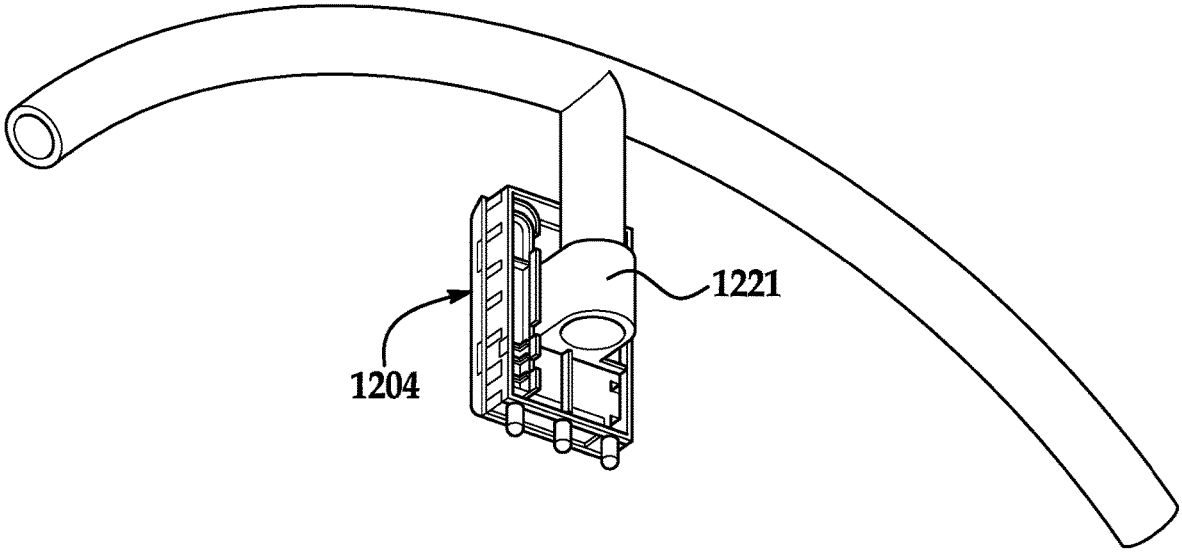
FIG. 46 is another schematic of the ultrasonic transducer assembly of FIG. 45.
Figure 47:
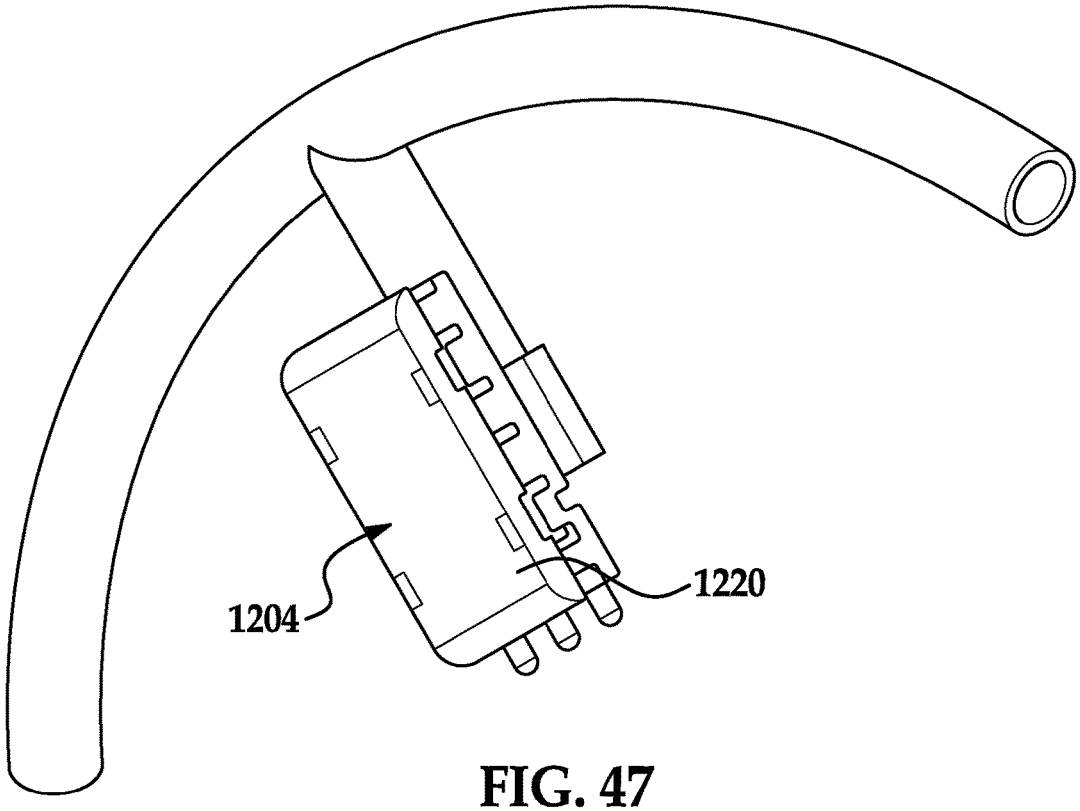
FIG. 47 is another schematic of the ultrasonic transducer assembly of FIG. 45.
Figure 48:
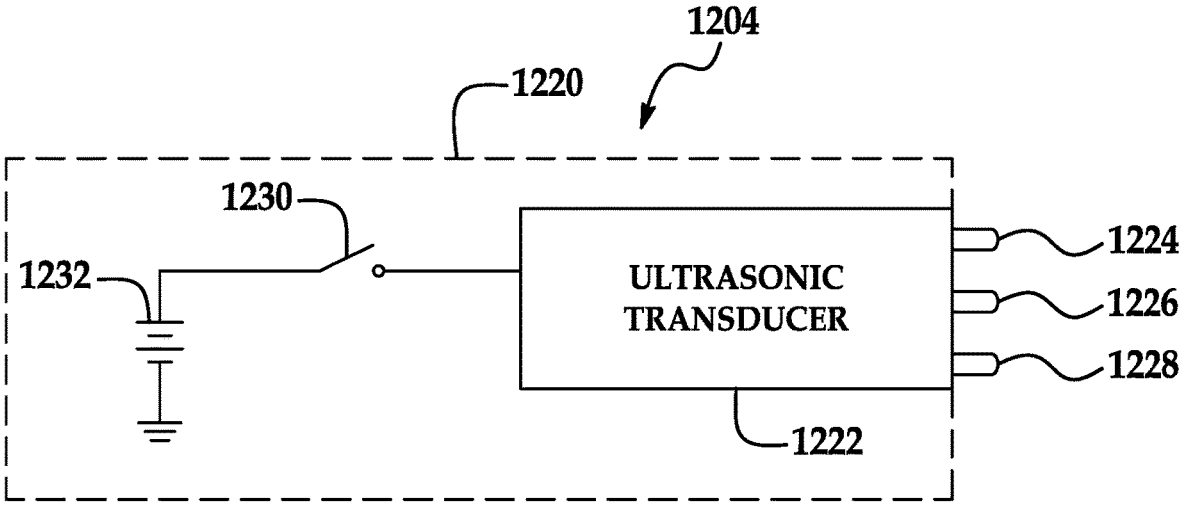
FIG. 48 is a block diagram of the ultrasonic transducer assembly of FIG. 45.

Referring to FIGS. 36, 37 and 44, a brief description of the coupling of the fourth member 414 to the third member 413 will be explained. The coupling tip 852 of the third member 413 is inserted into the main tubular portion 1050 of the arcuate-shaped portion 1030 of the fourth member 414 such that the tabs 902, 904 (shown in FIG. 44) of the coupling tip 852 of the third member 413 are received in the internal grooves 1080, 1082 of the main tubular portion 1050 of the arcuate-shaped portion 1030 of the fourth member 414. Further, the button tab 922 of the third member 413 is depressed during the insertion of the coupling tip 852 into the main tubular portion 1050, and thereafter is biased through the aperture 1066 of the main tubular portion 1050 of the arcuate-shaped portion 1030 of the fourth member 414—to couple the fourth member 414 to the third member 413.

Figure 24:
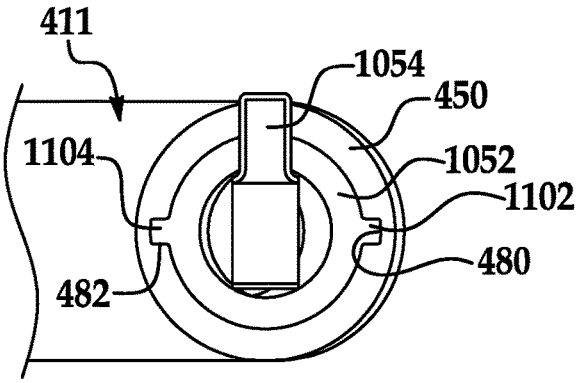
FIG. 24 is a cross-sectional schematic of the muscle therapy device of FIG. 17 taken along lines 24-24 in FIG. 17.
Figure 25:
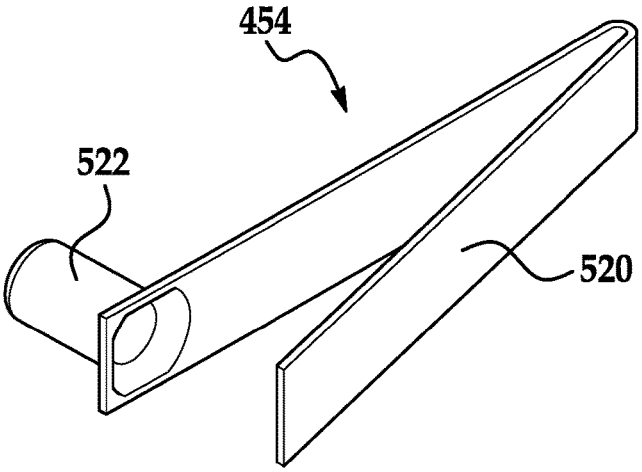
FIG. 25 is a schematic of a button connector utilized in the muscle therapy device of FIG. 16.
Figure 26:
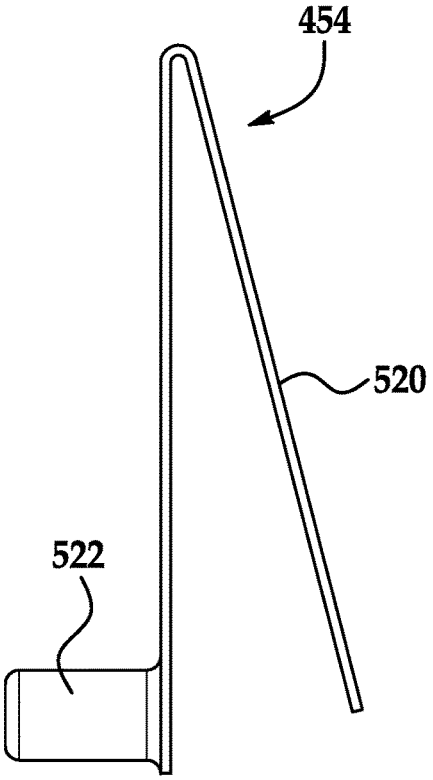
FIG. 26 is another schematic of the button connector of FIG. 25.

Referring to FIGS. 24, 42 and 43, a brief description of the coupling of the fourth member 414 to the first member 411 will be explained. The coupling tip 1052 of the fourth member 414 is inserted into the main tubular portion 450 of the arcuate-shaped portion 430 of the first member 411 such that the tabs 1102, 1104 (shown in FIG. 42) of the coupling tip 1052 of the fourth member 414 are received in the internal grooves 480, 482 of the main tubular portion 450 of the arcuate-shaped portion 430 of the first member 411. Further, the button tab 1122 of the fourth member 414 is depressed during the insertion of the coupling tip 1052 into the main tubular portion 450, and thereafter is biased through the aperture 466 of the main tubular portion 450 of the arcuate-shaped portion 430 of the first member 411—to couple the fourth member 414 to the first member 411.

It is noted that when the arcuate-shaped portions 430, 630, 830, 1030 are coupled together, the arcuate-shaped portions 430, 630, 830, 1030 define a substantially ring-shaped member. In an exemplary embodiment, an outer periphery of the coupled arcuate-shaped portions 430, 630, 830, 1030 is substantially circular-shaped, and an inner periphery of the coupled arcuate-shaped portions 430, 630, 830, 1030 is substantially circular-shaped. In an alternative embodiment, an outer periphery of the coupled arcuate-shaped portions 430, 630, 830, 1030 is substantially oval-shaped, and an inner periphery of the coupled arcuate-shaped portions 430, 630, 830, 1030 is substantially oval-shaped.

Referring to FIGS. 45-48, an ultrasonic transducer assembly 1204 that could replace any of the above-described tip members is illustrated. The ultrasonic transducer assembly 1204 includes a housing 1220, an attachment bracket 1221, an ultrasonic transducer 1222, extension members 1224, 1226, 1228, a switch 1230, and a battery 1232.

The ultrasonic transducer 1222 and the battery 1232 are disposed in the housing 1220. The ultrasonic transducer 1222 is operably coupled to the extension members 1224, 1226, 1228 which extend outwardly from the housing 1220.

The attachment bracket 1221 is adapted to removably couple the housing 1220 to any of the above-described protrusion members of the muscle therapy device 10 or the muscle therapy device 400.

The switch is disposed on an exterior of the housing 1220. The switch 1230 is electrically coupled in series between the battery 1232 and the ultrasonic transducer 122. When the switch 1230 has a closed operational position, an operational voltage from the battery 1232 is applied to the ultrasonic transducer 1222 which vibrates the extension members 1224, 1226, 1228 which could contact body portions of the user 12. When the switch 1230 has an open operational position, an operational voltage from the battery 1232 is removed from the ultrasonic transducer 1222 which stops vibrating the extension members 1224, 1226, 1228.

In yet another embodiment, for example, as depicted in FIGS. 49-57, a muscle therapy device 1300 may have a ring shaped member 1302. The ring shaped member 1302 may have at least a portion that has an H-shaped cross section. Advantageously, the ring shape and the H-shaped cross section of the ring shaped member 1302 improve the rigidity and durability of the muscle therapy device. It should be further appreciated that ring shape and the H-shaped cross section of the ring shaped member 1302 militate against undesirable bending of the muscle therapy device 1300, in operation.

The ring shaped member 1302 may also have at least one protrusion member 1304. The at least one protrusion member 1304 may be coupled to the ring shaped member 1302 such that the at least one protrusion 1304 extends radially inwardly from the ring shaped member 1302. At least one tip member 1306 may be disposed on the at least on protrusion member 1304.

Figure 49:
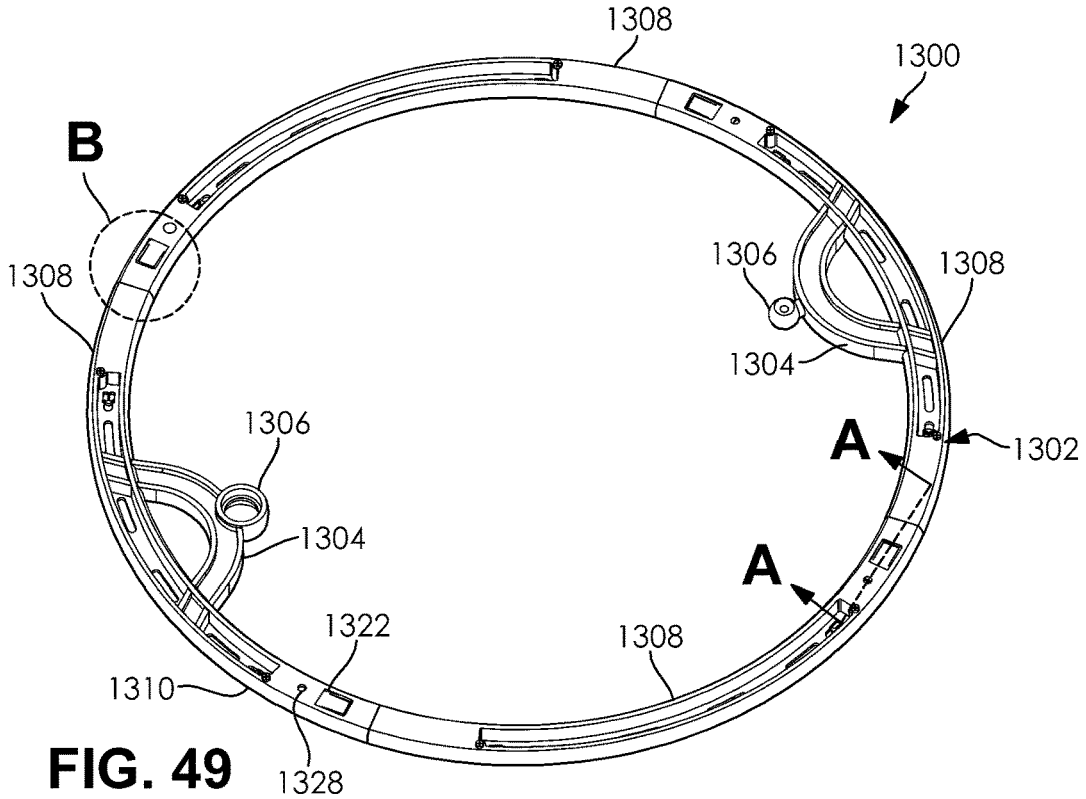
FIG. 49 is a top perspective view of the muscle therapy device, according to an additional embodiment of the present disclosure.
Figure 52:
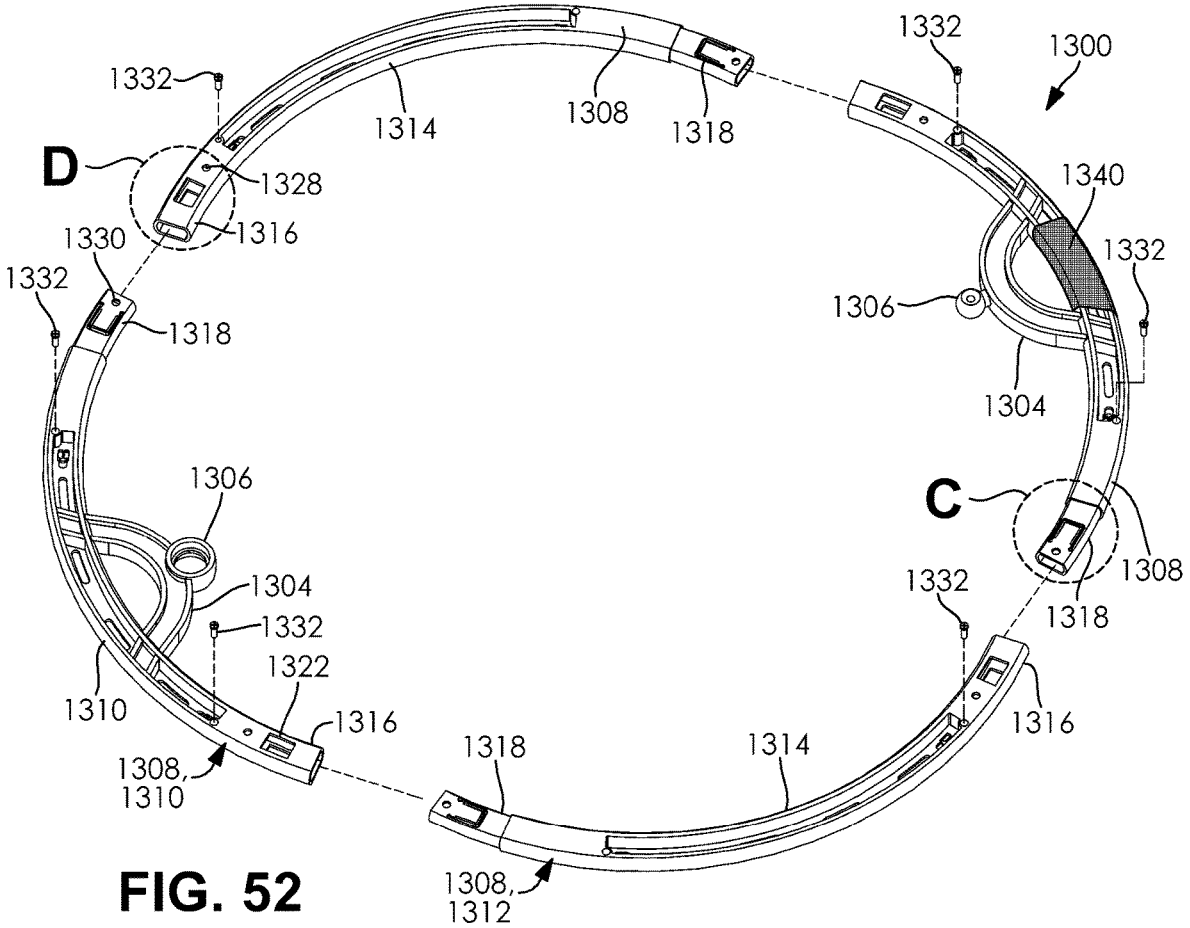
FIG. 52 is an exploded, top perspective view of the muscle therapy device shown in FIG. 49.

The ring shaped member 1302 may include a plurality of arcuate portions 1308. In particular the plurality of arcuate portions 1308 may include a first arcuate portion 1310 and a second arcuate portion 1312, for example, as shown in FIGS. 49 and 52. The plurality of arcuate portions 1308 may be removably connected to form the ring shaped member 1302. In a particular example, there are four (4) of the arcuate portions 1308 that together connect to form the ring shaped member 1302 upon assembly. However, a skilled artisan may select any other suitable number of arcuate portions 1308, as desired.

Each of the arcuate portions 1308 may include a main body 1314. At least a portion of the main body 1314 may have the H-shaped cross section. The main body 1310 may be disposed between a female end 1316 and a male end 1318. Advantageously, the female end 1316 of the first arcuate portion 1310 may interact with the male end 1318 of the second arcuate portion 1312 and thereby connecting the first and second arcuate portions 1310, 1312.

Figure 53:
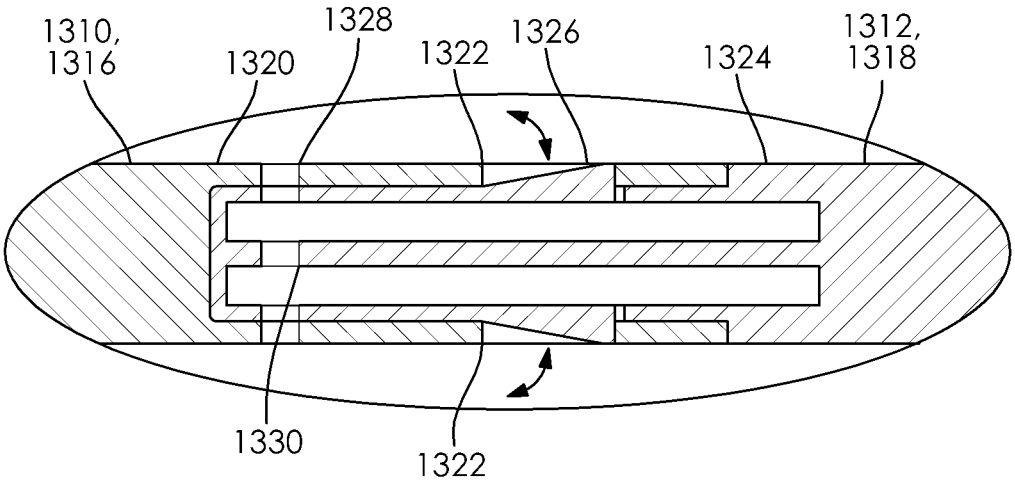
FIG. 53 is an enlarged, cross sectional, side elevational view of a connection between a female end and a male end of the muscle therapy device taken at section line A-A in FIG. 49.
Figure 55:
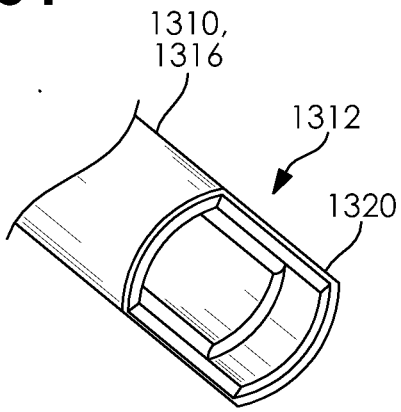
FIG. 55 is an enlarged, front perspective view of the female end taken at callout D in FIG. 52.

More specifically, and as shown in FIG. 55, the female end 1316 of each of the arcuate portions 1308 may be hollow. The female end 1316 may be defined by at least one arcuate side wall 1320. The female end 1316 may have at least one aperture 1322, for example, as shown in FIGS. 52 and 53, that is formed through the at least one arcuate side wall 1320. It should be appreciated that the female end 1316 is defined by arcuate surfaces, such that the female end 1316 has an arcuate shape.

Figure 54:
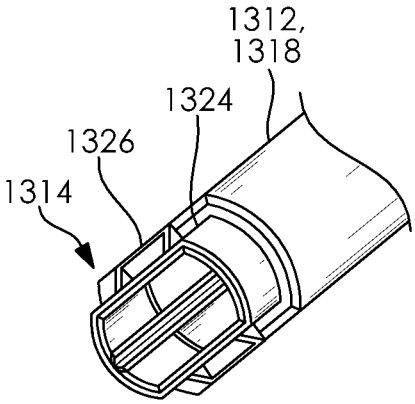
FIG. 54 is an enlarged, front perspective view of the male end taken at callout C in FIG. 52.
Figure 57:
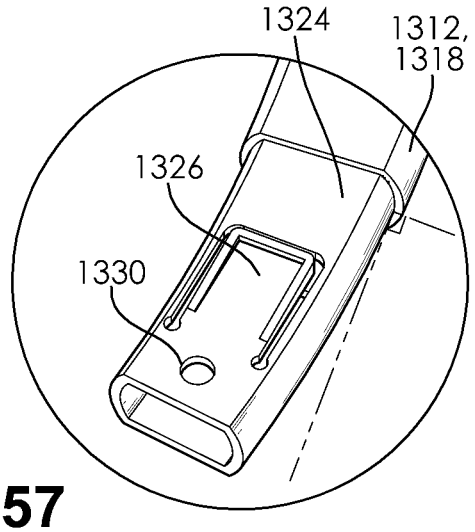
FIG. 57 is an enlarged, fragmentary, top perspective view of the muscle therapy device taken at callout C of FIG. 52, and further depicting an arcuate shape of the male end.

As depicted in FIG. 54, the male end 1318 of each of the arcuate portions 1308 may be defined by at least one arcuate side wall 1324. At least one button connector 1326 may be formed in the at least one arcuate side wall 1324. The button connector 1326 may have a tapered surface such that a portion of the button connector 1326 is raised at an angle above the at least one sidewall 1324 of the male end 1318, for example, as shown in FIG. 54. The button connector 1326 may be configured to be depressed below the at least one side wall 1326 in operation. It should be appreciated that the male end 1318 is defined by arcuate surfaces, such that the male end 1318 has an arcuate shape, for example, as shown in FIG. 57 by comparison to a straight line axis.

The button connector 1326 may have a like shape, which corresponds with a shape of the aperture 1322 of the female end 1316 of each of the arcuate portions 1308. In operation, the user may insert the male end 1318 of the first arcuate portion 1310 into the female end 1316 of the second arcuate portion 1312. The button connector may be depressed automatically due to the tapered surface, thereby allowing the male end 1318 to be disposed in the female end 1316. The button connector 1326 may then snap into place in the aperture 1322 of the female end 1316 due to a spring force associated with the button connector 1326. The first and second arcuate portion 1310, 1312 may then be separated by a user manually depressing the button connector 1326 from the aperture 1322, thereby permitting the male end 1318 to be removed from the female end 1316 of the adjacent arcuate portions 1308.

In a most particular embodiment, as shown in FIG. 53, each of the first and second arcuate portions 1310, 1312 may have a pair of button connectors 1326. Each of the button connectors may be disposed on opposite side walls 1324. Each of the arcuate portions 1308 may have a pair of apertures 1322. The apertures 1322 may be disposed on the opposite side walls 1320.

It should be appreciated that a skilled artisan may select any suitable size, shape, and configuration for the elements of the female end 1316 and the male end 1318 of each of the arcuate portions 1308, as desired.

Figure 56:
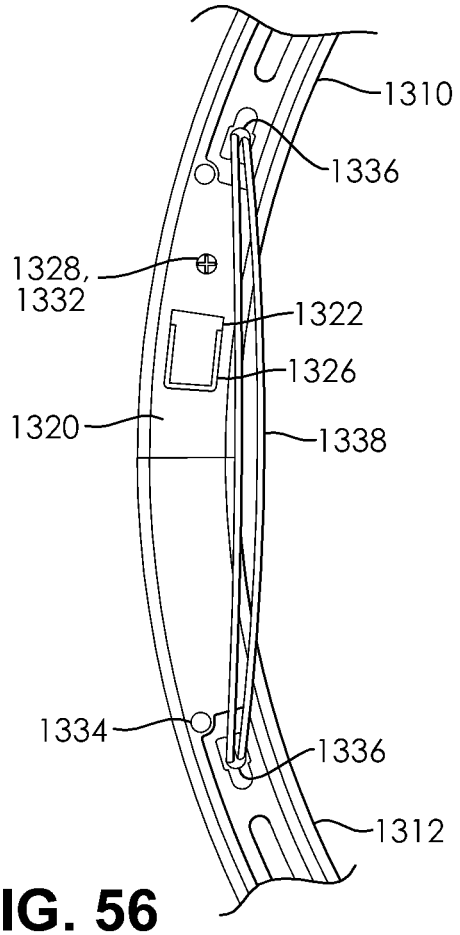
FIG. 56 is an enlarged, fragmentary, top plan view of the muscle therapy device taken at callout B in FIG. 49, and further depicting a pair of hooks connected to a elongate fastener.

As depicted in FIGS. 53 and 56, the female end 1316 may have a lock hole 1328 formed in the at least one arcuate side wall 1320. The male end 1318 may also have a lock hole 1330 formed in the at least one arcuate side wall 1324, as shown in FIG. 57. Each of the lock holes 1328, 1330 are positioned such that the lock hole 1328 of the female end 1316 is aligned with the lock hole 1330 of the male end 1318 where the first and second arcuate portions 1310, 1312 are connected. A lock screw 1332 may be disposed through the lock holes 1328, 1330 where aligned. Advantageously, the lock holes 1328, 1330 and the lock screw 1332 secure the first arcuate portion 1310 to the second arcuate portion 1312, thereby militating against the arcuate portion 1310 and the second arcuate portion 1312 undesirably separating during use. A skilled artisan may select any other suitable means for securing the first arcuate portion 1310 to the second arcuate portion 1312 within the scope of the present disclosure.

With reference to FIG. 56, the main body 1314 of each of the arcuate portions 1308 may have at least one storage hole 1334 formed therein. The storage hole 1334 may be configured to receive the lock screw 1332 where the lock screw is not in use to secure the first arcuate portion 1310 to the second arcuate portion 1312. Advantageously, the storage hole 1334 may militate against an undesirable loss of the lock screw 1332 where not in use. A skilled artisan may select any other suitable fastener to secure the first arcuate portion 1310 to the second arcuate portion 1312.

As shown in FIG. 56, the main body 1314 of each of the arcuate portions 1308 may further have at least one hook 1336. The hook 1336 may be disposed in an aperture adjacent to at least one of the female end 1316 and the male end 1318. The hook 1336 may be configured to receive an elongate fastener 1338. As a non-limiting example, the elongate fastener 1338 may be a rubber band. A skilled artisan may select any suitable fastener to connect the hooks 1336 of the muscle therapy device, as desired.

In operation, the elongate fastener 1338 may disposed on both the hook 1336 of the first arcuate portion 1310 and the hook 1336 of the second arcuate portion 1310 where the first arcuate portion 1310 is disconnected from the second arcuate portion 1312. Advantageously, the elongate fastener 1338 may aid the user in correctly aligning the first arcuate portion 1310 and the second arcuate portion 1312 during an assembly process, in order to connect the first and second arcuate portions 1310, 1312.

Figure 50:
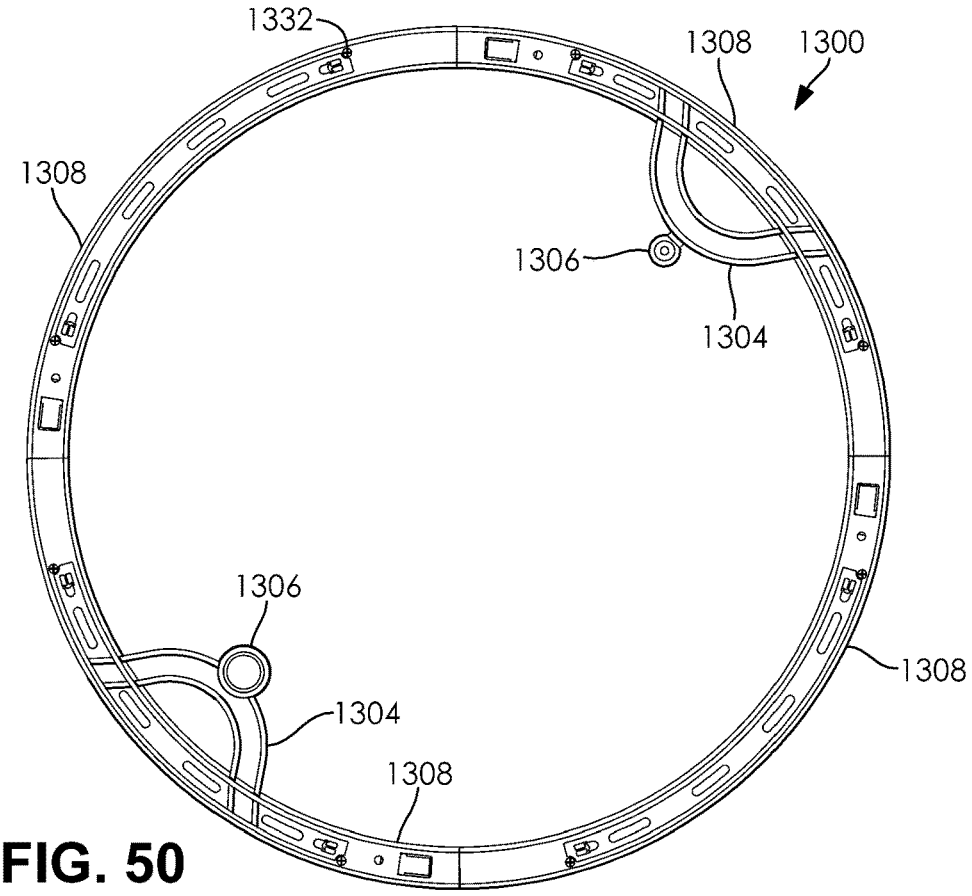
FIG. 50 is a top plan view of the muscle therapy device shown in FIG. 49.
Figure 51:
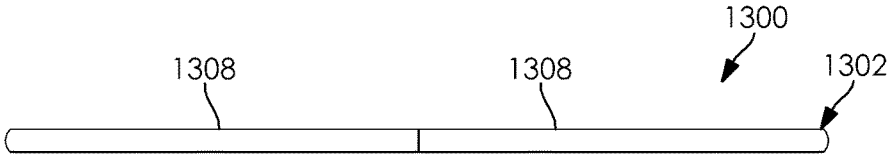
FIG. 51 is a side elevational view of the muscle therapy device shown in FIG. 49.

With renewed reference to FIGS. 49 and 50, each of the arcuate portions 108 may include the at least one protrusion member 1304 with the least one tip member 1306 disposed thereon. In a more particular embodiment, two of the arcuate portions 108 may include the protrusion member 1304 having a tip member 1306. Where the plurality of arcuate portions 1308 are connected to form the ring shaped member 1302, one of protrusion members 1304 may be disposed on the ring shaped member directly across from where an other one of the protrusion members 1304 is disposed on the ring shaped member 1302, for example, as shown in FIGS. 49-50 and 52.

The protrusion member 1304 may have a shape configured to provide rigidity to the structure of the protrusion member 1304. As a non-limiting example, the protrusion member 1304 maybe semicircular or arch shaped. The tip member 1306 may be disposed at an apex of the arch. A skilled artisan may select any suitable shape for the protrusion member 1304, as desired.

As shown in FIG. 52, the muscle therapy device 1300 may further include a protective cover 1340. The protective cover 1340 may be disposed on at least a portion of the ring shaped member 1302. More specifically, the protective cover 1340 may be disposed on the ring shaped member 1302 below the arch of the protrusion member 1304, as shown in FIG. 53. As a non-liming example, the protective cover 1340 may be formed from a neoprene material; however, other suitable materials may also be employed within the scope of the present disclosure. Advantageously, the protective cover 1340 may militate against damage to the user's wall or the muscle therapy device 1300, in operation. A skilled artisan may select other suitable placements for the protective cover 1340, as desired.

The present disclosure further includes a method for using the muscle therapy device 1300, as shown in FIG. 1, and also detailed hereinbelow. A first step of the method may be providing the muscle therapy device 1300, as described hereinabove.

A second step of the method may be positioning the muscle therapy device 1300 at a predetermined location. The user may require the muscle therapy device 1300 at a location such as the user's back or neck. The user may position the muscle therapy device 1300 such that the tip member 1306 of the protrusion member 1304 is positioned adjacent to the predetermined location.

A third step in the method may be applying pressure to the muscle therapy device 1300. When the muscle therapy device is in the predetermined location, the user may apply pressure to the device. The pressure may be applied by pushing the muscle therapy device 1300 away from the user's body. Alternatively, the user may push the muscle therapy device 1300 against a wall, with the muscle therapy device 1300 being disposed between the body of the user and the wall.

A fourth step in the method may be contacting the predetermined location with the tip member 1306 of the muscle therapy device 1300. When the user applies pressure to the muscle therapy device 1300, the tip member 1306 may contact the predetermined location. The user may repeat this process, as necessary, to treat the predetermined location with the muscle therapy device 1300.

The muscle therapy device 10, 400, 1300 described herein provide a substantial advantage over other devices. In particular, an advantage of the muscle therapy device 10, 400, 1300 is that it utilizes a substantially ring-shaped member 20, 1302 having first and second protrusions members 71, 72, 432, 632, 832, 1032, 1304 with different lengths that could easily contact different body portions of a user. Further, the substantially ring-shaped member 20, 1302 allows the user to more easily apply a force from the tip members 81, 82, 83, 434, 634, 834, 1034, 1306 of the muscle therapy device 10, 400, 1300 to body portions of the user, as compared to non-ring shaped devices.

While the claimed invention has been described in detail in connection with only a limited number of embodiments, it should be readily understood that the invention is not limited to such disclosed embodiments. Rather, the claimed invention could be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A muscle therapy device, comprising: a ring shaped member, at least a portion of the ring shaped member having an H-shaped cross section defined by a channel and a center support member, each of the channel and the center support member running a length of the portion of the ring shaped member, wherein the H-shaped cross section is adapted to stiffen the ring shaped member and the channel is open and the center support member is exposed; at least one protrusion member coupled to the ring shaped member, the at least one protrusion member extending radially inwardly from the ring shaped member; and at least one tip member disposed on the at least one protrusion member.

2. The muscle therapy device of claim 1, wherein the ring shaped member is comprised of a plurality of arcuate portions removably coupled, including a first arcuate portion and a second arcuate portion.

3. The muscle therapy device of claim 2, wherein each of the plurality of arcuate portions has a main body, the main body having at least a portion with the H-shaped cross section disposed between a male end and a female end.

4. The muscle therapy device of claim 3, wherein the male end of the first arcuate portion is selectively, removably coupled to the female end of the second arcuate portion.

5. The muscle therapy device of claim 4, wherein the female end has a hollow portion defined by at least one side wall.

6. The muscle therapy device of claim 5, wherein at least one aperture is formed in the at least one side wall.

7. The muscle therapy device of claim 6, wherein the male end has at least one button connector disposed on at least one side wall.

8. The muscle therapy device of claim 7, wherein the button connector of the male end of the first arcuate portion disposed in the aperture of the female end of the second arcuate portion.

9. The muscle therapy device of claim 3, wherein each arcuate portion has at least one hook.

10. The muscle therapy device of claim 9, wherein the at least one hook disposed on the main body adjacent to at least one of the male end and the female end.

11. The muscle therapy device of claim 10, wherein the at least one hook includes a pair of hooks, with one of the pair of hooks disposed adjacent to the male end and an other of the pair of hooks disposed adjacent to the female end.

12. The muscle therapy device of claim 1, wherein the at least one protrusion member is a plurality of protrusion members including a first protrusion member and a second protrusion member.

13. The muscle therapy device of claim 1, wherein the at least one protrusion member has a semi-circular shape.

14. The muscle therapy device of claim 1, wherein the at least one protrusion member is a pair of protrusion members, including a first protrusion member and a second protrusion member.

15. The muscle therapy device of claim 14, wherein the first protrusion member is disposed on the ring shaped member opposite to where the second protrusion member is disposed on the ring shaped member.

16. The muscle therapy device of claim 3, wherein each of the female end and the male end have at least one lock hole formed therethrough.

17. The muscle therapy device of claim 16, wherein when the male end of a first arcuate portion is inserted into the female end of a second arcuate portion, the at least one lock hole of the female end of the second arcuate portion is disposed above the at least one lock hole of the male end of the first arcuate portion.

18. The muscle therapy device of claim 16, wherein the lock holes are configured to receive a fastener.

19. A muscle therapy device, comprising: a ring shaped member, at least a portion of the ring shaped member having an H-shaped cross section defined by a channel and a center support member, each of the channel and the center support member running a length of the portion of the ring shaped member, wherein the H-shaped cross section is adapted to stiffen the ring shaped member and the channel is open and the center support member is exposed, the ring shaped member having a plurality of arcuate portions including a first arcuate portion and a second arcuate portion, each of the plurality of arcuate portions having a main body, the main body having at least a portion with the H-shaped cross section disposed between a male end and a female end, the male end of the first arcuate portion is selectively, removably coupled to the female end of the second arcuate portion, wherein the female end has a hollow portion defined by at least one side wall, at least one aperture is formed in the at least one side wall wherein the male end has at least button connector disposed on at least one side wall, the button connector of the male end of the first arcuate portion disposed in the aperture of the female end of the second arcuate portion; at least one protrusion member coupled to the ring shaped member, the at least one protrusion member extending radially inwardly from the ring shaped member; and at least one tip member disposed on the at least on protrusion member, wherein each of the arcuate portions has a pair of hooks, with one of the pair of hooks disposed adjacent to the male end and an other of the pair of hooks disposed adjacent to the female end, wherein the at least one protrusion member is a plurality of protrusion members including a first protrusion member and a second protrusion member, each of the protrusion members having a semi-circular shape, the first protrusion member is disposed on the ring shaped member opposite to where the second protrusion member is disposed on the ring shaped member, wherein each of the female end and the male end have at least one lock hole formed therethrough, the at least one lock hole of the female end is disposed above the at least one lock hole of the male end, the lock holes configured to receive a fastener.

20. A method of using a muscle therapy device, the method comprising the steps of: providing the muscle therapy device, the muscle therapy device having a ring shaped member, at least a portion of the ring shaped member having an H-shaped cross section defined by a channel and a center support member, each of the channel and the center support member running a length of the portion of the ring shaped member, wherein the H-shaped cross section is adapted to stiffen the ring shaped member and the channel is open and the center support member is exposed, at least one protrusion member coupled to the ring shaped member, the at least one protrusion extending radially inwardly from the ring shaped member, and at least one tip member disposed on the at least on protrusion member; positioning the muscle therapy device at a predetermined location on a body of a user; applying pressure to the muscle therapy device; and contacting the predetermined location with the at least one tip member of the muscle therapy device.

* * * * *